US010149579B2

(12) United States Patent
Goltz et al.

(10) Patent No.: US 10,149,579 B2
(45) Date of Patent: Dec. 11, 2018

(54) SHEET PRODUCT DISPENSERS AND RELATED METHODS FOR AUTOMATICALLY LOADING A ROLL OF SHEET PRODUCT IN A DISPENSER

(71) Applicant: GPCP IP Holdings LLC, Atlanta, GA (US)

(72) Inventors: Ryan Anthony Goltz, Neenah, WI (US); Mark Edwin Peters, New London, WI (US); Alan Joseph Johnson, Kaukauna, WI (US); Justin Matthew Oliphant, Neenah, WI (US); Paul James Ruthven, Neenah, WI (US)

(73) Assignee: GPCP IP Holdings LLC, Atlanta, GA (US)

( * ) Notice: Subject to any disclaimer, the term of this patent is extended or adjusted under 35 U.S.C. 154(b) by 170 days.

(21) Appl. No.: 14/595,683

(22) Filed: Jan. 13, 2015

(65) Prior Publication Data

US 2015/0196174 A1 Jul. 16, 2015

Related U.S. Application Data

(60) Provisional application No. 61/926,767, filed on Jan. 13, 2014, provisional application No. 62/008,897, filed on Jun. 6, 2014.

(51) Int. Cl.
*A47K 10/42* (2006.01)
*B65D 83/08* (2006.01)
(Continued)

(52) U.S. Cl.
CPC ..... *A47K 10/421* (2013.01); *A47K 10/3618* (2013.01); *A47K 10/426* (2013.01);
(Continued)

(58) Field of Classification Search
CPC .... A47K 10/36; A47K 10/421; A47K 10/426; A47K 2010/3233; A47K 2010/3266; A47K 2010/3281; B65D 83/0805
See application file for complete search history.

(56) References Cited

U.S. PATENT DOCUMENTS 1,354,511 A 10/1920 Parsons
2,144,757 A 1/1939 Gilling et al.
(Continued)

FOREIGN PATENT DOCUMENTS

JP 9075258 A 3/1997

OTHER PUBLICATIONS

Written Opinion of the International Searching Authority for PCT/US2015/011168 dated Apr. 30, 2015.

*Primary Examiner* — Michael E Gallion
(74) *Attorney, Agent, or Firm* — Eversheds Sutherland (US) LLP

(57) ABSTRACT

A sheet product dispenser for dispensing sheet product from a roll of sheet product having a sealed tail is provided. The sheet product dispenser includes a roll interface configured to engage and at least partially support the roll of sheet product, the roll interface including a separating member configured to engage and unseal the sealed tail; a feed roller assembly configured to dispense sheet product from the roll of sheet product, the feed roller assembly including a feed roller configured to engage and at least partially support the roll of sheet product; and a controller operable to initiate driving of the feed roller and rotation of the roll of sheet product such that the sealed tail is unsealed by engaging the separating member. A related method of automatically loading a roll of sheet product having a sealed tail in a sheet product dispenser also is provided.

20 Claims, 11 Drawing Sheets

(51) Int. Cl.
*A47K 10/36* (2006.01)
*A47K 10/32* (2006.01)

(52) U.S. Cl.
CPC .. *B65D 83/0805* (2013.01); *A47K 2010/3233* (2013.01); *A47K 2010/3266* (2013.01); *A47K 2010/3681* (2013.01)

(56) References Cited

U.S. PATENT DOCUMENTS 2,295,005 A 9/1942 Peacock et al.
2,334,689 A * 11/1943 Wooster ..... A47K 10/3827 225/39
3,672,552 A * 6/1972 Krueger ..... A47K 10/36 226/129
3,713,170 A 1/1973 Kaufman
3,861,610 A * 1/1975 Landis ..... B65H 20/04 242/564.1
3,971,607 A * 7/1976 Schnyder ..... A47K 10/28 312/34.12
4,141,516 A * 2/1979 Olson ..... A47K 10/36 226/129
4,358,169 A * 11/1982 Filipowicz ..... A47K 10/3687 225/34
4,403,748 A * 9/1983 Cornell ..... A47K 10/3687 226/129
4,580,738 A * 4/1986 Scheer ..... B65H 23/085 242/156.1
4,807,824 A * 2/1989 Gains ..... A47K 10/3687 242/560.1
D300,492 S 4/1989 Pearce
4,846,412 A * 7/1989 Morand ..... A47K 10/3687 225/106
4,960,248 A * 10/1990 Bauer ..... A47K 10/36 242/564.4
5,060,877 A * 10/1991 Bullivant ..... B65H 16/08 242/564.5
5,244,263 A * 9/1993 Kennedy ..... A47K 10/28 226/131
5,375,920 A * 12/1994 Macchi Cassia ..... A47K 10/28 312/34.12
5,542,487 A 8/1996 Schultz et al.
5,772,291 A * 6/1998 Byrd ..... A47K 10/36 242/563.2
5,857,393 A * 1/1999 Kohiyama ..... A47K 10/36 83/167
5,868,275 A * 2/1999 Moody ..... A47K 10/16 221/33
6,152,397 A * 11/2000 Purcell ..... A47K 10/3687 242/560.1
6,161,795 A * 12/2000 Skerrett ..... A47K 10/36 242/564.5
6,228,454 B1 * 5/2001 Johnson ..... A47K 10/16 428/43
6,241,118 B1 6/2001 Tramontina
6,302,351 B1 * 10/2001 Omdoll ..... A47K 10/36 242/564.2
6,354,462 B1 3/2002 Conran et al.
6,419,113 B1 7/2002 Tramontina
6,537,631 B1 3/2003 Rivera et al.
6,655,630 B2 * 12/2003 Newman ..... A47K 10/32 242/598.5
6,659,391 B1 12/2003 Faulks et al.
6,682,013 B1 1/2004 Newman et al.
6,684,751 B2 * 2/2004 Kapiloff ..... A47K 10/36 225/16
6,695,246 B1 * 2/2004 Elliott ..... A47K 10/36 242/563
6,702,227 B1 3/2004 Newman et al.
6,705,565 B1 3/2004 Newman et al.
6,706,352 B2 3/2004 Rivera et al.
6,745,975 B2 6/2004 Faulks et al.
6,785,946 B2 9/2004 Romme et al.
6,826,985 B2 * 12/2004 Broehl ..... A47K 10/36 225/1
6,830,151 B2 12/2004 Spencer et al.
7,004,435 B2 2/2006 Formon
7,011,272 B2 3/2006 Faulks et al.
7,188,799 B1 3/2007 Lindsay et al.
7,207,461 B2 4/2007 Mitchell et al.
7,213,782 B2 * 5/2007 Osborne ..... A47K 10/36 242/563
7,294,378 B2 11/2007 Rivera et al.
D578,328 S 10/2008 Plum et al.
7,644,885 B2 1/2010 Briante et al.
8,205,748 B2 6/2012 Long et al.
8,444,008 B2 5/2013 Al-Mahnna
8,511,599 B2 * 8/2013 Lalau ..... A47K 10/36 242/563
8,550,396 B2 * 10/2013 Marrs ..... A47K 10/34 242/564
8,608,022 B1 12/2013 Kory
8,616,489 B2 * 12/2013 Goeking ..... A47K 10/26 242/563.1
9,010,602 B2 * 4/2015 Budz ..... A47K 10/36 225/16
9,211,042 B2 * 12/2015 Rozek ..... A47K 10/34
9,248,988 B2 * 2/2016 Keily ..... A47K 10/34
2001/0001475 A1 * 5/2001 Formon ..... A47K 10/36 242/563.2
2001/0032859 A1 * 10/2001 Coleman ..... A47K 10/421 221/213
2002/0033405 A1 * 3/2002 Gergek ..... A47K 10/36 225/96
2002/0073821 A1 * 6/2002 Broehl ..... A47K 10/36 83/436.15
2002/0117578 A1 * 8/2002 Denen ..... A47K 10/36 242/563
2003/0041716 A1 * 3/2003 Takashima ..... A47K 10/36 83/649
2003/0110911 A1 * 6/2003 Kapiloff ..... A47K 10/36 83/208
2003/0116003 A1 * 6/2003 Kapiloff ..... A47K 10/36 83/649
2003/0132261 A1 * 7/2003 Formon ..... A47K 10/36 225/2
2003/0164079 A1 * 9/2003 Budz ..... A47K 10/36 83/649
2004/0124202 A1 7/2004 Mitchell et al.
2005/0167541 A1 * 8/2005 Osborne ..... A47K 10/36 242/563
2005/0275153 A1 * 12/2005 Owa ..... A47K 10/36 271/121
2006/0173576 A1 * 8/2006 Goerg ..... A47K 10/36 700/236
2007/0194166 A1 * 8/2007 Reinsel ..... A47K 10/36 242/563
2009/0026305 A1 * 1/2009 Elliott ..... A47K 10/36 242/563.2
2009/0057478 A1 * 3/2009 Conner ..... A47K 10/36 242/564
2009/0101748 A1 * 4/2009 Maddaleni ..... B65H 18/28 242/541.2
2009/0250484 A1 * 10/2009 Kling ..... A47K 10/36 221/14
2010/0012675 A1 * 1/2010 Formon ..... A47K 10/36 221/13
2010/0032445 A1 2/2010 Bunoz
2010/0224647 A1 9/2010 Formon et al.
2010/0314429 A1 12/2010 Troutman et al.
2011/0108598 A1 * 5/2011 Bruner ..... A47K 10/38 225/10
2011/0226887 A1 * 9/2011 Marrs ..... A47K 10/34 242/564
2011/0276178 A1 * 11/2011 Petersen ..... A47K 10/36 700/236
2012/0167739 A1 * 7/2012 Lewis ..... A47K 10/36 83/663

(56) References Cited

U.S. PATENT DOCUMENTS

| | | | | |
|---|---|---|---|---|
| 2013/0105614 | A1* | 5/2013 | Hjort | B65H 16/106<br>242/564.5 |
| 2013/0161346 | A1* | 6/2013 | Wolme | A47K 10/38<br>221/26 |
| 2013/0213995 | A1* | 8/2013 | Horel | A47K 10/36<br>221/197 |
| 2015/0097068 | A1* | 4/2015 | Larson | A47K 10/36<br>242/563 |

* cited by examiner

SHEET PRODUCT DISPENSERS AND RELATED METHODS FOR AUTOMATICALLY LOADING A ROLL OF SHEET PRODUCT IN A DISPENSER

CROSS-REFERENCE TO RELATED APPLICATIONS

This application claims the benefit of U.S. Provisional Application No. 61/926,767, filed on Jan. 13, 2014, and U.S. Provisional Application No. 62/008,897, filed on Jun. 6, 2014, both of which are incorporated herein by reference in their entirety.

FIELD OF THE DISCLOSURE

The present disclosure relates generally to sheet product dispensers and more particularly to sheet product dispensers and related methods for automatically loading a roll of sheet product in a dispenser for dispensing therefrom.

BACKGROUND

Various types of sheet product dispensers are known in the art, including mechanical and automated dispensers configured to allow a user to obtain a length of sheet product from a roll of sheet product disposed within the dispenser. Sheet product dispensers generally are configured to dispense a particular type of sheet product, such as bath tissue, facial tissue, wipes, napkins, or paper towels. Additionally, sheet product dispensers often are configured for use in a certain environment, such as a home, commercial, industrial, or medical environment, taking into account the operating conditions, expected user traffic, and distinct performance requirements. For example, in some medical environments, such as the patient rooms of hospitals or other medical facilities, user traffic at the dispenser may be relatively low, but performance requirements of the dispenser may be great, due at least in part to an increased need for hygienic operation as well as efficiency demands of medical personnel who was their hands frequently.

According to certain configurations, sheet product dispensers may be automated devices configured to rotatably support the roll within the dispenser for dispensing sheet product therefrom. During operation of such dispensers, a dispensing mechanism may advance a length of sheet product out of the dispenser for a user to grasp and separate from the roll, as may be facilitated by a tear bar of the dispenser or a predefined area of weakness, such as a line of perforations, defined in the sheet product. In this manner, during use of the dispenser, the user touches only the sheet product that is removed, while the roll remains protected within the dispenser.

Depending on the frequency of their use, sheet product dispensers may require frequent reloading of sheet product by facility environmental services (EVS) personnel, such as janitorial personnel, in order to meet user demand. For certain dispensers, a new roll of sheet product may be loaded into the dispenser by opening a cover of the dispenser, unsealing a "tail" (i.e., an exposed end portion of the sheet product) of the roll from a remainder of the roll, mounting the roll within the dispenser via roll supports or stub spindles of the dispenser, positioning the unsealed tail adjacent to or in a portion of the dispensing mechanism (such as adjacent to or in an in-running nip) or under a transfer bar, and closing the cover. This process of loading the dispenser may present several shortcomings. In particular, the loading process may be time-consuming and cumbersome for EVS personnel because of the need to manually unseal the tail and position the unsealed tail in a particular manner with respect to the dispensing mechanism or the transfer bar. Moreover, the new roll of sheet product may be exposed to unsanitary conditions and potential contaminants during transport of the roll to the dispenser and/or loading of the roll in the dispenser. For example, the roll often may be removed from a case or other packaging prior to being transported to the dispenser, and thus the roll may come into contact with airborne environmental contaminants. Additionally, EVS personnel may directly handle the roll during transport and/or loading, creating a risk of cross-contamination.

These shortcomings may be particularly significant for dispensers used in certain medical environments, such as the patient rooms of hospitals or other medical facilities. Due to the large number of patient rooms and thus the large number of dispensers in such facilities, the inefficient dispenser loading process may result in a high overall cost of maintaining the dispensers loaded with sheet product as well as user frustration on the part of EVS personnel. Additionally, the risk of exposing new rolls of sheet product to contaminants during transport and/or loading of the rolls may be of great concern in such facilities, where hygienic practices are critical for preventing hospital-acquired infections.

There is thus a desire for improved sheet product dispensers and related methods for loading a roll of sheet product in a dispenser for dispensing therefrom. Such dispensers and methods should address one or more of the shortcomings noted above while also satisfying the performance requirements of the intended operating environment.

SUMMARY

In one aspect, a sheet product dispenser for dispensing sheet product from a roll of sheet product having a sealed tail is provided. The sheet product dispenser includes a roll interface configured to engage and at least partially support the roll of sheet product, the roll interface including a separating member configured to engage and unseal the sealed tail; a feed roller assembly configured to dispense sheet product from the roll of sheet product, the feed roller assembly including a feed roller configured to engage and at least partially support the roll of sheet product; and a controller operable to initiate driving of the feed roller and rotation of the roll of sheet product such that the sealed tail is unsealed by engaging the separating member.

In another aspect, a method of automatically loading a roll of sheet product having a sealed tail in a sheet product dispenser is provided, including placing the roll of sheet product in the dispenser such that the roll of sheet product rests on and is substantially supported by a dispensing mechanism and a roll interface, and rotating a feed roller of the dispensing mechanism to unseal the sealed tail and direct the unsealed tail into the dispensing mechanism via a separating member of the roll interface.

In another aspect, a method of automatically loading a roll of sheet product having a sealed tail in a sheet product dispenser is provided. The method includes the steps of engaging the roll of sheet product with a roll interface and a feed roller of the sheet product dispenser; initiating driving of the feed roller and rotation of the roll of sheet product; and unsealing the sealed tail by rotating the roll of sheet product such that the sealed tail engages a separating member of the roll interface.

In yet another aspect, a sheet product dispenser system for dispensing sheet product from a roll of sheet product having a sealed tail is provided. The sheet product dispenser system includes a cartridge configured to contain the roll of sheet product therein, at least one of the cartridge and the sheet product dispenser comprising a separating member configured to engage and unseal the sealed tail. The sheet product dispenser system also includes a sheet product dispenser including a cartridge interface configured to engage and support the cartridge; a feed roller assembly configured to dispense sheet product from the roll of sheet product, the feed roller assembly including a feed roller configured to engage and at least partially support the roll of sheet product; and a controller operable to initiate driving of the feed roller and rotation of the roll of sheet product such that the sealed tail is unsealed by engaging the separating member.

In another aspect, a method of automatically loading a roll of sheet product having a sealed tail in a sheet product dispenser is provided. The method includes the steps of engaging a cartridge containing the roll of sheet product with a cartridge interface of the sheet product dispenser; engaging the roll of sheet product with a roll interface of the cartridge and a feed roller of the sheet product dispenser; initiating driving of the feed roller and rotation of the roll of sheet product; and unsealing the sealed tail by rotating the roll of sheet product such that the sealed tail engages a separating member of the roll interface.

These and other aspects and improvements of the present disclosure will become apparent to one of ordinary skill in the art upon review of the following detailed description when taken in conjunction with the several drawings and the appended claims.

BRIEF DESCRIPTION OF THE DRAWINGS

The detailed description is set forth with reference to the accompanying drawings illustrating examples of the disclosure, in which use of the same reference numerals indicates similar or identical items. Certain embodiments of the present disclosure may include elements, components, and/or configurations other than those illustrated in the drawings, and some of the elements, components, and/or configurations illustrated in the drawings may not be present in certain embodiments.

DETAILED DESCRIPTION

Figure 1A:
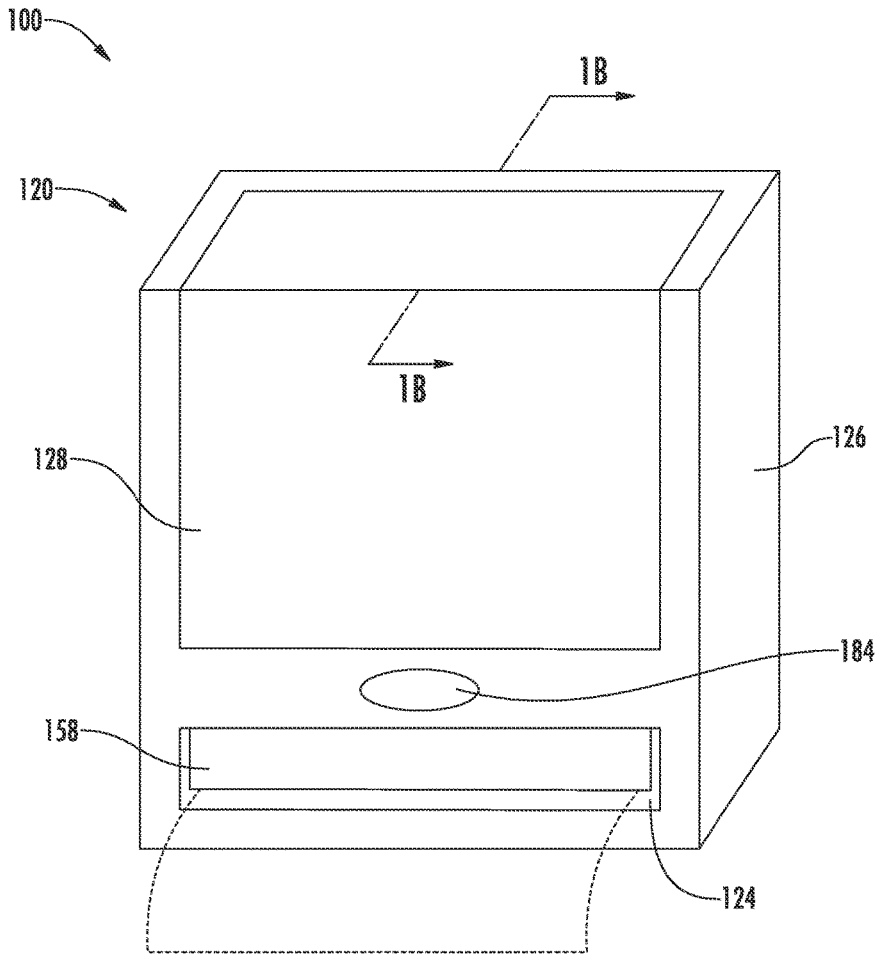
FIG. 1A is a perspective view of a sheet product dispenser in accordance with one or more embodiments of the disclosure.

As described above, existing sheet product dispensers and related methods for loading a roll of sheet product in a dispenser may present several shortcomings. In particular, the process of loading a new roll in such dispensers may require EVS personnel to carry out the time-consuming and cumbersome steps of manually unsealing a tail of the roll and positioning the unsealed tail in a particular manner with respect to the dispensing mechanism or the transfer bar. Moreover, such methods may allow the new roll to be exposed to unsanitary conditions and potential contaminants during transport of the roll to the dispenser and/or loading of the roll in the dispenser. These shortcomings ultimately may result in a high overall cost of maintaining the dispensers, user frustration on the part of EVS personnel, and a risk of contaminating the sheet product with germs that may be passed along to end users of the dispensers.

The sheet product dispensers and related methods provided herein for loading a roll of sheet product in a dispenser have been developed to address one or more of the shortcomings noted above. Such dispensers advantageously may simplify the process of loading a new roll by automatically unsealing a sealed tail of the roll and feeding the unsealed tail through a dispensing mechanism, thereby reducing the time and effort required on the part of EVS personnel. Additionally, such methods may minimize exposure of the new roll to unsanitary conditions and potential contaminants during transport of the roll to the dispenser as well as loading of the roll in the dispenser, thereby encouraging hygienic practices. The sheet product dispensers and methods provided herein may be particularly beneficial for use in certain medical environments, such as the patient rooms of hospitals or other medical facilities, where loading efficiency and hygienic operation are critical.

The present disclosure includes non-limiting embodiments of sheet product dispensers and related methods for loading a roll of sheet product in a dispenser, which simplify the process of loading a new roll and/or minimize exposure of the new roll to unsanitary conditions and potential contaminants. The embodiments are described in detail herein to enable one of ordinary skill in the art to practice the sheet product dispensers and related methods, although it is to be understood that other embodiments may be utilized and that logical changes may be made without departing from the scope of the disclosure. Reference is made herein to the accompanying drawings illustrating some embodiments of the disclosure, in which use of the same reference numerals indicates similar or identical items. Throughout the disclosure, depending on the context, singular and plural terminology may be used interchangeably.

As used herein, the term "sheet product" is inclusive of natural and/or synthetic cloth or paper sheets. Sheet products may include both woven and non-woven articles. There are a wide variety of non-woven processes for forming sheet products, which can be either wetlaid or drylaid. Examples of non-woven processes include, but are not limited to, hydroentangled (sometimes called "spunlace"), double recreped (DRC), airlaid, spunbond, carded, papermaking, and melt-blown processes. Further, sheet products may contain fibrous cellulosic materials that may be derived from natural sources, such as wood pulp fibers, as well as other fibrous material characterized by having hydroxyl groups. Examples of sheet products include, but are not limited to, wipes, napkins, tissues, such as bath tissues or facial tissues, towels, such as paper towels, and other fibrous, film, polymer, or filamentary products. In general, sheet products are thin in comparison to their length and width and exhibit a relatively flat planar configuration but are flexible to permit folding, rolling, stacking, and the like. Sheet products may include predefined areas of weakness, such as lines of perforations, extending across their width between individual sheets to facilitate separation or tearing of one or more sheets from a roll or folded arrangement of the sheet product at discrete intervals. The individual sheets may be sized as desired to accommodate particular uses of the sheet product.

As used herein, the term "roll of sheet product" refers to a sheet product formed in a roll by winding layers of the sheet product around one another. Rolls of sheet product may have a generally circular cross-sectional shape, a generally oval cross-sectional shape, or other cross-sectional shapes according to various winding configurations of the layers of sheet product. Rolls of sheet product may be cored or coreless.

The meanings of other terms used herein will be apparent to one of ordinary skill in the art or will become apparent to one of ordinary skill in the art upon review of the detailed description when taken in conjunction with the several drawings and the appended claims.

FIGS. 1A-1D illustrate a sheet product dispenser 100 (which also may be referred to as an "auto-loading sheet product dispenser") according to one or more embodiments of the disclosure. The dispenser 100 is configured to allow a user to obtain a length of sheet product from a roll 102 of sheet product supported by the dispenser 100. As described in detail below, the dispenser 100 is configured to automatically load the roll 102 of sheet product when the roll 102 is placed therein.

Figure 2:
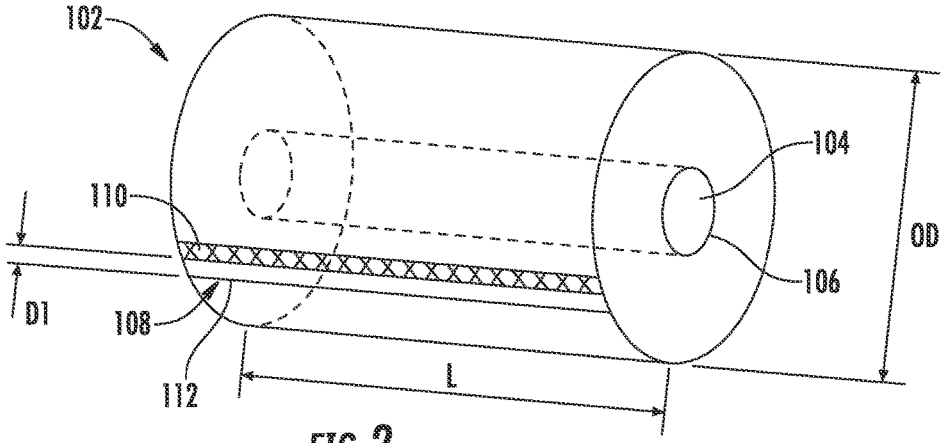
FIG. 2 is a perspective view of a roll of sheet product in accordance with one or more embodiments of the disclosure, as may be used with the sheet product dispensers disclosed herein.

FIG. 2 illustrates the roll 102 of sheet product according to one or more embodiments of the disclosure. The sheet product may be paper towels, although other types of sheet product, such as bath tissue, facial tissue, wipers, or napkins may be used in the dispenser 100. The roll 102 of sheet product may be formed in a conventional manner, whereby layers of the sheet product are wound around one another. As shown, the roll 102 may have a length L and an outer diameter OD defining a generally cylindrical overall shape and a circular cross-sectional shape. The roll 102 may include a central opening 104 extending therethrough along a longitudinal axis of the roll 102. As shown, the roll 102 may be a cored roll of sheet product, including a core 106 of paperboard or other material defining the central opening 104 and around which the layers of sheet product are wound. Alternatively, the roll 102 may be a coreless roll of sheet product, such that the central opening 104 is defined by an inner layer of the sheet product. In some embodiments, which may have a cored or coreless configuration, the roll 102 includes one or more removable shafts, plugs, or other members positioned within the central opening 104 for structural support during shipping or transportation, which may or may not be removed prior to loading the roll 102 in the dispenser 100.

In some embodiments, the sheet product includes predefined areas of weakness, such as lines of perforations, extending across a width of the sheet product between individual sheets thereof. In this manner, a user may separate one or more sheets from the roll 102 by tearing the sheet product along one of the areas of weakness. In other embodiments, the sheet product includes no predefined areas of weakness, such that the sheet product is formed as a continuous sheet. In this manner, a user may separate a length of sheet product from the roll 102 by tearing the sheet product at any desired location, as may be achieved by an abrupt pulling action and as may be facilitated by a tear bar 158 of the dispenser 100, as described below.

As shown in FIG. 2, a tail 108 of the roll 102 of sheet product may be sealed to a remainder of the roll 102 along a sealed region 110. For example, the tail 108 may be sealed to an adjacent layer of the sheet product along the sealed region 110 by a glue, adhesive, or other bonding agent. As shown, the sealed region 110 may be positioned near a distal end 112 (i.e., distal edge) of the tail 108 but offset from the distal end 112 by a distance D1, such that the distal end 112 is free from the adjacent layer of sheet product. In some embodiments, the sealed region 110 extends continuously across the width of the sheet product. In other embodiments, the sealed region 110 extends intermittently across the width of the sheet product. For use of the roll 102, the sealed tail 108 may be unsealed from the remainder of the roll 102 by applying a separating force to the sealed tail 108, as may be facilitated by certain features of the dispenser 100 described below.

Figure 1B:
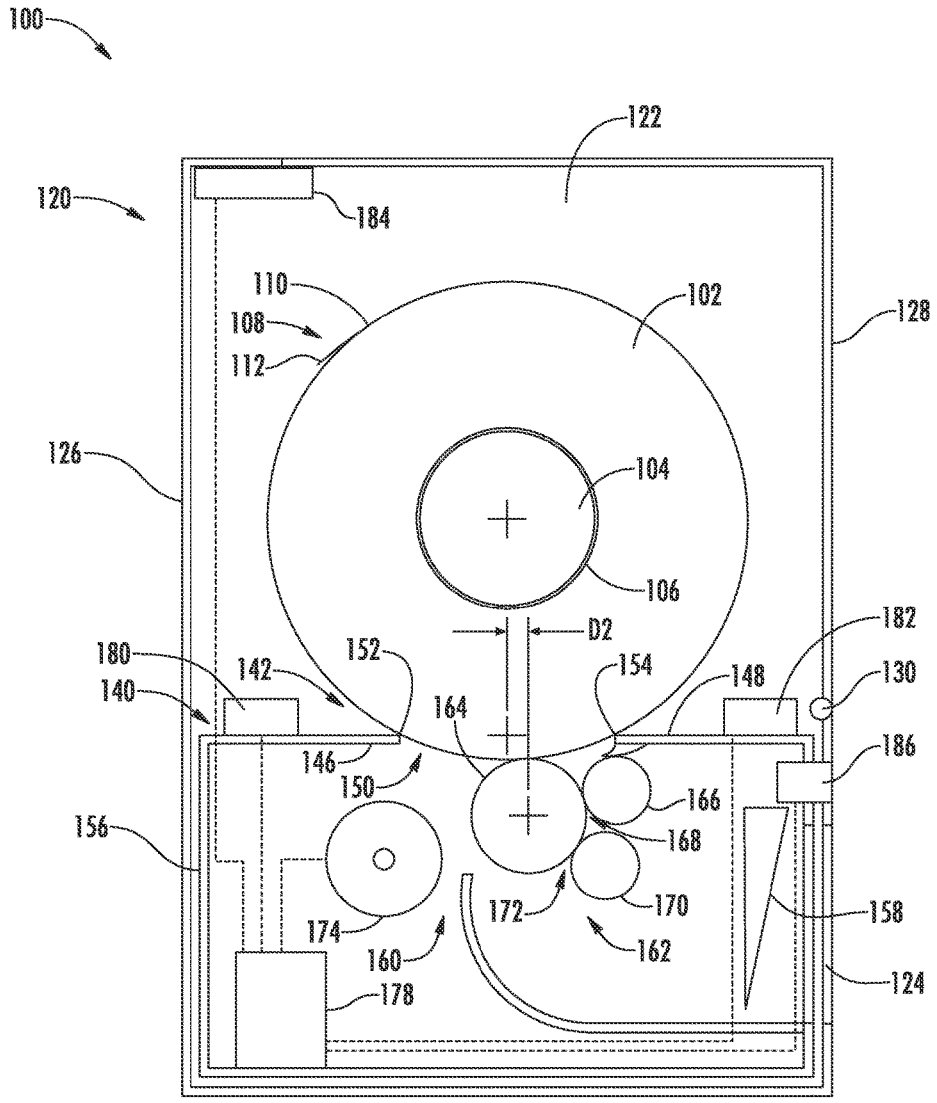
FIG. 1B is a side cross-sectional view of the sheet product dispenser of FIG. 1A taken along line 1B-1B, showing a roll of sheet product after initial placement of the roll in the sheet product dispenser.
Figure 1C:
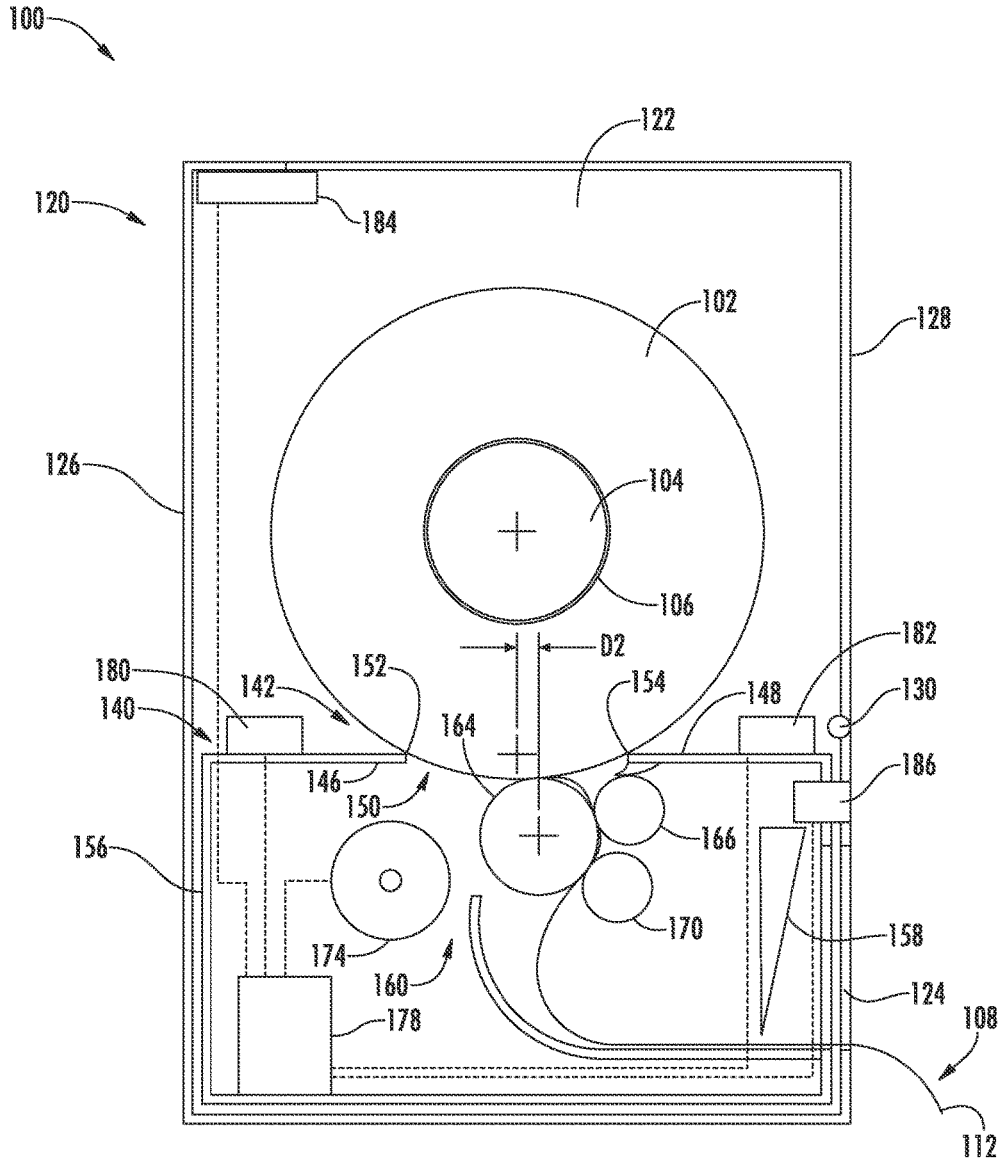
FIG. 1C is a side cross-sectional view of the sheet product dispenser of FIG. 1A, similar to the view of FIG. 1B, showing the roll of sheet product after automatic loading of the roll in the sheet product dispenser.

As shown in FIGS. 1A-1C, the sheet product dispenser 100 may include a housing 120. During use of the dispenser 100, the roll 102 may be disposed completely within the housing 120 for dispensing sheet product therefrom. The housing 120 may include a plurality of walls and may define an interior space 122 inward of the walls and configured to receive the roll 102 therein. The interior space 122 may be substantially closed by the housing 120, although certain gaps or openings may be defined by the housing 120, as described below. The housing 120 may include a dispenser opening 124 defined in one or more of the walls and configured to allow the sheet product to be dispensed therethrough. As shown, the dispenser opening 124 may be defined in a lower portion of the front wall of the housing 120, although other locations of the dispenser opening 124 may be used. During use of the dispenser 100, the sheet product may be directed through the dispenser opening 124 and out of the housing 120, such that the sheet product may be easily grasped by a user.

The housing 120 may include a base or first housing portion 126 configured to attach to a wall or other support surface for mounting the dispenser 100 thereto. For example, the back wall of the base 126 may be attached to a vertical wall, the bottom wall of the base 126 may be attached to a countertop surface, or the top wall of the base 126 may be attached to an under-counter surface. The housing 120 also may include a cover or second housing portion 128 movably connected to the base 126 and configured to move between a closed position for dispensing sheet product, as shown in FIGS. 1A-1C, and an open position for placing the roll 102 of sheet product within the interior space 122. For example, the cover 128 may be pivotally connected to the base 126 via one or more pin connections 130, as shown.

As shown in FIGS. 1B and 1C, the sheet product dispenser 100 also may include a dispenser chassis 140. The dispenser chassis 140 may be positioned at least partially within the housing 120. In some embodiments, as shown, the chassis 140 is positioned entirely within the housing 120. In other embodiments, a portion of the chassis 140 is positioned within the housing 120 while another portion of the chassis 140 is positioned outside of the housing 120. Alternatively, the dispenser chassis 140 may be positioned entirely outside of but adjacent to and in communication with the housing 120. For example, the housing 120 may be positioned on top of and attached to the dispenser chassis 140, and the dispenser opening 124 may be defined in the chassis 140 alone. In some embodiments, exterior surfaces of the dispenser chassis 140 may form a portion of the housing 120. In some embodiments, the dispenser 100 may not include a housing 120 at all, such that the roll 102 of sheet product is exposed atop the dispenser chassis 140. The foregoing embodiments are merely illustrative, as other configurations of the housing 120 and the dispenser chassis 140 of the dispenser 100 are possible.

As shown, the dispenser chassis 140 may include a roll interface 142 configured to engage and at least partially support the roll 102 of sheet product. The roll interface 142 may include a first member 146 (which also may be referred to as a "folding member" for reasons described below) and a second member 148 (which also may be referred to as a "separating member" for reasons described below). The first member 146 and the second member 148 may be spaced apart from one another to define a chassis opening 150 (which also may be referred to as a "roll interface opening") therebetween. As shown, the chassis opening 150 may extend along a length of the chassis 140 and may be configured to allow a portion of the roll 102 to extend therethrough. The first member 146 may be positioned along a back portion of the chassis 140, and the second member 148 may be positioned along a front portion of the chassis 140, as shown. In this manner, the first member 146 may be configured to engage a back, lower portion of the roll 102, and the second member 148 may be configured to engage a front, lower portion of the roll 102 when the roll 102 extends through the chassis opening 150. In some embodiments, as described in more detail below, the roll interface 142 includes only one of the first member 146 and the second member 148.

As shown, the first member 146 may have an elongated shape including a first edge 152 extending along the back of the chassis opening 150 and configured to engage the back, lower portion of the roll 102. In a similar manner, the second member 148 may have an elongated shape including a second edge 154 extending along the front of the chassis opening 150 and configured to engage the front, lower portion of the roll 102. For example, the first member 146 and the second member 148 may be shaped as blades. One or both of the first edge 152 and the second edge 154 may be a sharp edge. Alternatively, one or both of the first edge 152 and the second edge 154 may be rounded, serrated, knurled, textured, or otherwise shaped to enhance friction between the respective portion of the roll 102 and the first member 146 or the second member 148. In some embodiments, as shown in FIG. 1D, the first edge 152 is a sharp edge, and the second edge 154 is serrated.

In some embodiments, the first member 146 and the second member 148 are formed separately from and attached to a frame 156 of the dispenser chassis 140. The first member 146 and the second member 148 may be attached to the frame 156 via one or more mechanical fasteners, such as screws, bolts and nuts, or rivets, or one or more glues, adhesives, or bonding agents. Accordingly, the first member 146 and the second member 148 may be replaceable. In other embodiments, as shown, the first member 146 and the second member 148 are integrally formed with the frame 156 of the dispenser chassis 140. Although the roll interface 142 is described above as being part of the dispenser chassis 140, the roll interface 142 alternatively may be part of the housing 120 or may be a separate component or sub-assembly of the dispenser 100.

As shown in FIGS. 1B and 1C, the dispenser 100 also may include a tear bar 158 positioned about the dispenser opening 124 and configured to facilitate tearing of a length of sheet product from the roll 102. In some embodiments, the tear bar 158 is a part of the dispenser chassis 140. For example, the tear bar 158 may be formed separately from and attached to the frame 156 of the dispenser chassis 140. Alternatively, the tear bar 158 may be integrally formed with the frame 156 of the chassis 140. In other embodiments, the tear bar 158 is a part of the housing 120. For example, the tear bar 158 may be attached to or integrally formed with either the base 126 or the cover 128. The tear bar 158 may be formed as a plate having a sharp distal edge, as shown, although other configurations of the tear bar 158 are possible.

Figure 1D:
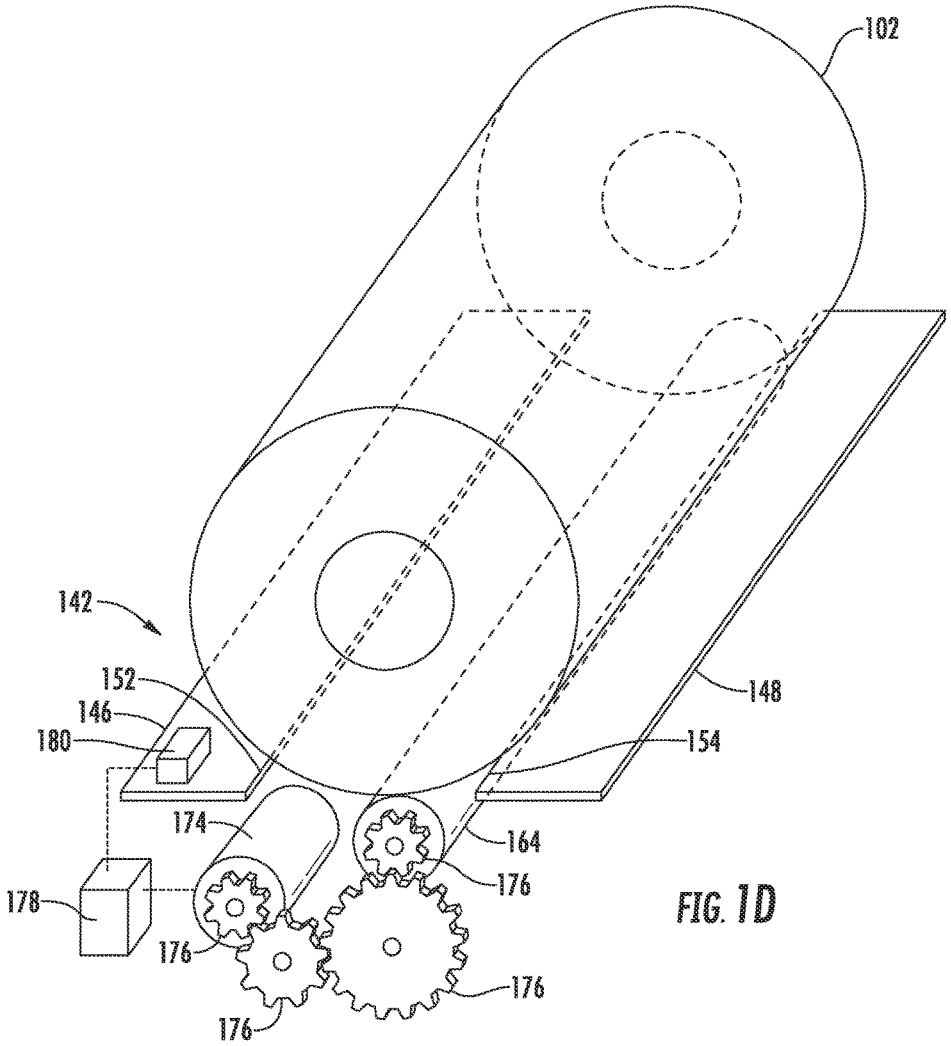
FIG. 1D is a perspective view of the roll of sheet product received within and supported by a cradle defined by a roll interface and a feed roller of the sheet product dispenser of FIG. 1A.

As shown in FIGS. 1B-1D, the sheet product dispenser 100 also may include a dispensing mechanism 160 configured to dispense the sheet product from the roll 102 and direct the sheet product out of the dispenser opening 124. The dispensing mechanism 160 may include a feed roller assembly 162 disposed within the dispenser chassis 140 and configured to dispense the sheet product from the roll 102. The feed roller assembly 162 may include a feed roller 164 (which also may be referred to as a "drive roller") and a first pinch roller 166 (which also may be referred to as an "upper pinch roller") defining a first nip 168 (which also may be referred to as an "in-running nip") therebetween for receiving and advancing the sheet product. The feed roller assembly 162 also may include a second pinch roller 170 (which also may be referred to as a "lower pinch roller") defining a second nip 172 (which also may be referred to as an "out-running nip") between the feed roller 164 and the second pinch roller 170 for receiving and advancing the sheet product. The second pinch roller 170 may increase the sheet product wrap around the feed roller 164 (i.e., the extent that the sheet product engages the outer surface of the feed roller 164), which may reduce potential slippage of the sheet product with respect to the feed roller 164. In some embodiments, the feed roller assembly 162 includes only the feed roller 164 and the first pinch roller 166. The foregoing embodiments are merely illustrative, as other configurations of the feed roller assembly 162 are possible.

As shown, the feed roller 164 may be disposed below the chassis opening 150 and configured to engage and at least partially support the bottom portion of the roll 102 of sheet product. In this manner, the first member 146, the second member 148, and the feed roller 164 may collectively form a cradle for receiving and supporting the roll 102. Thus, the roll interface 142 may engage and at least partially support the roll 102 by directly contacting the roll 102 and supporting at least a portion of the weight of the roll 102. Similarly, as discussed in more detail below, at least a portion of the feed roller assembly 162 may also directly contact the roll 102 and may support at least a portion of the weight of the roll 102. In some embodiments, the feed roller assembly engages and supports the roll via the drive roller 164. For example, an outermost surface of the drive roller 164 may abut and directly contact an outermost surface of the roll 102, such as along a lower portion of the roll 102 and an upper portion of the drive roller 164. In some embodiments, substantially all of the weight of the roll 102 is supported by one or both of the roll interface 142 and the feed roller assembly 162, eliminating the need for roll supports or other structures in the dispenser or cartridges for suspending or otherwise supporting the weight of the roll 102.

In embodiments, the first member, second member, and feed roller together support all or a substantial portion of the weight of the roll of sheet product. Thus, the roll may be loaded by merely placing it on the roll interface such that it comes into contact with the members and feed roller. This drop and load feature eliminates the need to load the roll onto roll holders.

In some embodiments, the dispenser 100 may include other means for at least partially supporting the roll 102 of sheet product, either in addition to or instead of the roll interface 142. For example, the dispenser 100 may include one or more roll holders associated with the housing 120 and configured to at least partially support the roll 102 about the central opening 104 thereof. Alternatively, the roll 102 may be at least partially supported by one or more roll holders associated with a wall external to the dispenser 100. In some embodiments, as shown, the roll 102 is not supported at all by a roll holder about the central opening 104 of the roll 102. The foregoing embodiments are merely illustrative, as other configurations for supporting the roll 102 are possible.

The dispensing mechanism 160 may include a motor 174 in operable communication with the feed roller 164 and configured to selectively drive the feed roller 164. In particular, the motor 174 may be in communication with the feed roller 164 via one or more gears 176. The motor 174 also may be in operable communication with a controller 178 of the dispenser 100, which may be configured to selectively activate the motor 174.

In some embodiments, the controller 178 is in operable communication with a roll sensor 180 configured to detect initial engagement between the roll interface 142 and the roll 102. Based on this configuration, the controller 178 may be operable to activate the motor 174, thereby initiating driving of the feed roller 164, in response to the roll interface 142 initially engaging the roll 102 as detected by the roll sensor 180. The roll sensor 180 may be a proximity sensor, a pressure sensor, or other type of sensor configured to detect initial placement of the roll 102 on the roll interface 142. In some embodiments, the dispenser 100 does not include a roll sensor 180.

In some embodiments, the controller 178 is in operable communication with an input device 182 configured to be directly manually activated, such as by EVS personnel. Based on this configuration, the controller 178 may be operable to activate the motor 174, thereby initiating driving of the feed roller 164, in response to manual activation of the input device 182. The input device 182 may be a button, a switch, or other type of device configured to be directly manually activated. The controller 178 may also be in operable communication with a proximity sensor 186 configured to detect the presence of a user's hand proximate the dispenser 100. Based on this configuration, the controller 178 may be operable to activate the motor 174, thereby initiating driving of the feed roller 164, in response to placement of a user's hand proximate the dispenser 100 as detected by the user proximity sensor 186. In some embodiments, the dispenser 100 includes the input device or proximity sensor in addition to the roll sensor 180. In some embodiments, the dispenser does not include an input device.

In some embodiments, the controller 178 is in operable communication with a cover switch 184 configured to be activated by closing of the cover 128 (i.e., movement of the cover 128 from the open position to the closed position). In this manner, the cover switch 184 may be indirectly manually activated by EVS personnel closing the cover 128 which in turn engages the cover switch 184. Based on this configuration, the controller 178 may be operable to activate the motor 174, thereby initiating driving of the feed roller 164, in response to activation of the cover switch 184. Although the cover switch 184 is shown positioned about a top, left portion of the housing 120, other positions of the cover switch 184 are possible. In some embodiments, the dispenser 100 includes the cover switch 184 in addition to the roll sensor 180 and/or the input device 182. In some embodiments, the dispenser does not include a cover switch 184.

In some embodiments, a method of automatically loading a roll of sheet product having a sealed tail in a sheet product dispenser includes placing the roll of sheet product in the dispenser such that the roll of sheet product rests on and is substantially supported by a dispensing mechanism and a roll interface, and rotating a feed roller of the dispensing mechanism to unseal the sealed tail and direct the unsealed tail into the dispensing mechanism via a separating member of the roll interface.

As noted above, the dispenser 100 is configured to automatically load the roll 102 of sheet product when the roll 102 is placed therein. A method for automatically loading the roll 102 in the dispenser 100 may begin by moving the cover 128 to the open position and placing the roll 102 of sheet product within the interior space 122 of the dispenser 100. As shown in FIG. 1B, the roll 102 may be placed in the dispenser 100 in an orientation such that the free distal end 112 of the sealed tail 108 extends away from the sealed region 110 in the direction of rotation of the roll 102. Although the roll 102 is shown placed in the dispenser 100 such that the sealed tail 108 is positioned about the back, upper portion of the roll 102, the roll 102 may be placed such that the sealed tail 108 is at any radial position with respect to the longitudinal axis of the roll 102.

Upon placing the roll 102 within the interior space 122, the roll 102 may be received within and supported by the cradle formed by the roll interface 142 and the feed roller 164, as shown. In some embodiments, in response to the roll interface 142 initially engaging the roll 102, the dispenser 100 may rotate the roll 102 (in the counter-clockwise direction according to the view of FIG. 1B). Specifically, in response to the roll interface 142 initially engaging the roll 102 as detected by the dispenser 100, for example by the roll sensor 180, the controller 178 may activate the motor 174, thereby driving the feed roller 164 and rotating the roll 102. In other embodiments, in response to manual activation of the input device 182 or other means for detecting a need for loading the roll 102, such as activation of a proximity sensor, the dispenser 100 may rotate the roll 102 (in the counter-clockwise direction according to the view of FIG. 1B). Specifically, in response to manual activation of the input device 182 or other means for detecting a need for loading the roll 102, the controller 178 may activate the motor 174, thereby driving the feed roller 164 and rotating the roll 102. In still other embodiments, in response to activation of the cover switch 184 or other means for detecting closure of the cover 128, the dispenser 100 may rotate the roll 102 (in the counter-clockwise direction according to the view of FIG. 1B). Specifically, in response to activation of the cover switch 184 or other means for detecting closure of the cover 128, the controller 178 may activate the motor 174, thereby driving the feed roller 164 and rotating the roll 102.

Upon rotation of the roll 102 of sheet product, the free distal end 112 of the sealed tail 108 may engage the second member 148, in particular the second edge 154 thereof, which may cause the free distal end 112 of the sealed tail 108 to be unsealed. Alternatively, upon rotation of the roll 102 of sheet product, the free distal end 112 of the sealed tail 108 may engage the first member 146, in particular the first edge 152 thereof, which may cause the free distal end 112 of the sealed tail 108 to be folded over. In such embodiments, the first edge 152 may fold the free distal end 112 of the tail 108 at least partially back over the sealed region 110. Upon further rotation of the roll 102, the sealed region 110 of the sealed tail 108 may engage the second member 148, in particular the second edge 154 thereof, which may cause the sealed tail 108 to unseal from the remainder of the roll 102. Specifically, the second edge 154 may unseal the sealed region 110, thereby separating the tail 108 from the adjacent layer of sheet product. Upon further rotation of the roll 102, the second member 148, in particular the second edge 154 thereof, may direct the unsealed tail 108 downward into the feed roller assembly 162. Specifically, the second member 148 may direct the unsealed tail 108 into the first nip 168. The controller 178 may continue to drive the feed roller 164 via the motor 174 such that the unsealed tail 108 is fed through the feed roller assembly 162 and out of the dispenser opening 124, as shown in FIG. 1C. In some embodiments, the controller 178 may deactivate the motor 174 and thus stop driving of the feed roller 164 upon expiration of a timer of the controller 178. In other embodiments, the controller 178 may deactivate the motor 174 and thus stop driving of the feed roller 164 in response to a sensor detecting that a length of sheet product including the unsealed tail 108 has extended out of the dispenser opening 124. The extended length of sheet product may be grasped by EVS personnel and removed from the roll 102, as may be facilitated by the tear bar 158. The loading process may be complete upon removal of the extended length of sheet product, such that the dispenser 100 is ready for dispensing the sheet product from the roll 102.

Dispensing of a length of the sheet product from the roll 102 for an end user may be carried out in a conventional manner. Specifically, in response to placement of a user's hand proximate the dispenser 100 as detected by the user proximity sensor 186, the controller 178 may activate the motor 174, thereby driving the feed roller 164 and advancing a length of the sheet product out of the dispenser opening 124 for the user to grasp and remove from the roll 102. In some embodiments, other means of activating the motor 174 may be used. In some embodiments, as the outer diameter OD of the roll 102 decreases due to removal of the sheet product, the roll 102 may move to the back side of the feed roller 164, such that the roll 102 disengages the second member 148. In this manner, upon moving to the back side of the feed roller 164, the roll 102 may be supported by only the first member 146 and the feed roller 164. The movement of the roll 102 and disengagement of the second member 148 beneficially may reduce dust generation that otherwise would be caused by the second member 148 constantly scraping against the roll 102 throughout the life of the roll 102. The movement of the roll 102 and disengagement of the second member 148 may be achieved by positioning the feed roller 164 such that the longitudinal axis of the feed roller 164 is offset in front of the longitudinal axis of the roll 102 by a distance D2, as shown. The magnitude of the offset distance D2 may be selected such that the roll 102 disengages the second member 148 after a certain amount of depletion of the roll 102. For example, the offset distance D2 may be selected such that the roll 102 disengages the second member 148 after 1 percent, 5 percent, 10 percent, or 25 percent depletion of the roll 102.

In other embodiments, the roll 102 may be located to the front side of the feed roller 164. This may be caused by placing the roll 102 such that it is supported solely by the feed roller 164 and the second member 148, or by a decrease in the outer diameter OD of the roll 102 and disengagement of the first member 146. The forward location of the roll 102 and/or disengagement of the first member 146 beneficially may reduce dust generation that otherwise would be caused by the first member 146 constantly scraping against the roll 102 throughout the life of the roll 102. The forward location of the roll 102 and/or disengagement of the first member 146 may be achieved by positioning the feed roller 164 such that the longitudinal axis of the feed roller 164 is offset from the longitudinal axis of the roll 102 by a distance in back of the longitudinal axis of the roll 102. In this manner, according to such embodiments, the feed roller 164 would offset from the longitudinal axis of the roll 102 in an opposite manner as compared to that shown in FIGS. 1B and 1C. The magnitude of the offset distance may be selected such that the roll 102 disengages the first member 146 after a certain amount of depletion of the roll 102. For example, the offset distance may be selected such that the roll 102 disengages the first member 146 after 1 percent, 5 percent, 10 percent, or 25 percent depletion of the roll 102.

The sheet product dispenser 100 and method for automatically loading the roll 102 in the dispenser 100 advantageously may simplify the loading process as compared to existing dispensers and methods. In particular, the dispenser 100 and method may reduce the time and effort required on the part of EVS personnel by eliminating the need to manually unseal the sealed tail 108 and position the unsealed tail 108 in a particular manner with respect to the dispensing mechanism 160. As described above, these steps may be performed automatically by the dispenser 100 either upon the roll interface 142 initially engaging the roll 102, upon manual activation of the input device 182, activation of a proximity sensor, or upon activation of the cover switch 184.

Figure 3:
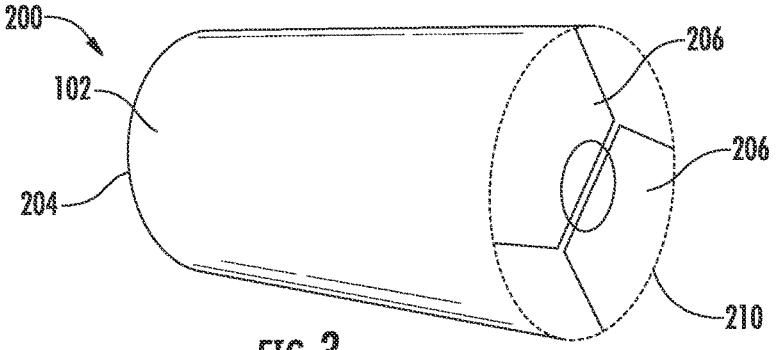
FIG. 3 is a perspective view of a wrapped roll of sheet product in accordance with one or more embodiments of the disclosure, as may be used with the sheet product dispensers disclosed herein.

FIG. 3 illustrates a wrapped roll 200 of sheet product according to one or more embodiments of the disclosure. The wrapped roll 200 may be used with the dispenser 100 or other sheet product dispensers. As shown, the wrapped roll 200 may include the roll 102 of sheet product described above and a wrapper 204 enclosing the roll 102. In this manner, the roll 102 may be contained within the wrapper 204 such that the wrapper 204 protects the roll 102 from potential contaminants during shipping, storage, and transport to the dispenser 100. The wrapper 204 may be formed of a polymer film that is flexible and able to conform to the shape of the roll 102. In some embodiments, the polymer is low density polyethylene, although other suitable polymers may be used. The polymer film may provide moisture protection of the roll 102, which may be desirable for operating environments where EVS personnel use wet wipes or other liquid cleaning supplies to clean surfaces of the environment.

In some embodiments, as shown, the wrapper 204 includes one or more flaps 206 that are folded over and sealed to adjacent portions of the wrapper 204, such that the wrapper 204 completely encloses the roll 102. The flaps 206 may be sealed to the adjacent portions of the wrapper 204 by a heat seal or by a glue, adhesive, or other bonding agent. The flaps 206 may extend along an end surface of the roll 102, as shown. In some embodiments, the wrapper 204 includes one or more flaps 206 extending along one end surface of the roll 102 and one or more flaps 206 extending along the other end surface of the roll 102. Alternatively, the flaps 206 may extend along the outer circumferential surface of the roll 102. The flaps 206 may be unsealed from the adjacent portions of the wrapper 204 by grasping the flaps 206 and applying a separating force thereto. Alternatively, the flaps 206 may be unsealed by grasping another portion of the wrapper 204, such as the outer circumferential surface thereof, and moving that portion with respect to the roll 102.

In some embodiments, either instead of or in addition to the flaps 206, the wrapper 204 includes one or more predefined areas of weakness 210, such as lines of perforations, extending along a portion of the wrapper 204. For example, the wrapper 204 may include a line of perforations along the edge at the intersection of one of the end surfaces of the roll 102 and the outer circumferential surface of the roll 102. Alternatively, the wrapper 204 may include a line of perforations along the length or the circumference of the outer circumferential surface of the roll 102. Adjacent portions of the wrapper 204 may be separated from one another by grasping one of the portions and applying a separating force thereto until the predefined areas of weakness 210 are broken. In some embodiments, the wrapper 204 may include a tab configured to be grasped and pulled by a user to facilitate separation of portions of the wrapper 204. For example, the tab may be configured in a manner similar to a chewing gum wrapper tab that extends away from the wrapper 204 and is easily accessible.

The wrapped roll 200 may be transported to the dispenser 100, and the wrapper 204 may be removed from the roll 102 immediately prior to placing the roll 102 in the dispenser 100. In some embodiments, removing the wrapper 204 from the roll 102 may include unsealing one or more flaps 206 of the wrapper 204. In some embodiments, removing the wrapper 204 from the roll 102 may include breaking one or more predefined areas of weakness 210 of the wrapper 204. After removal of the wrapper 204, the roll 102 may be placed into the dispenser 100 and automatically loaded therein according to the method described above.

The wrapped roll 200 advantageously may minimize exposure of the roll 102 to unsanitary conditions and potential contaminants during shipping, storage, and transport of the roll 102 to the dispenser 100. Additionally, the wrapped roll 200 may reduce the risk of cross-contamination, as EVS personnel may handle the roll 102 indirectly via the wrapper 204. In this manner, the wrapped roll 200 may encourage hygienic practices, which may be particularly beneficial in medical environments.

Figure 4:
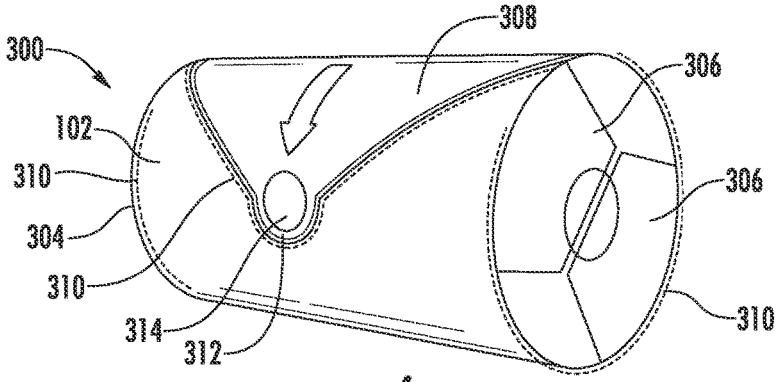
FIG. 4 is a perspective view of a wrapped roll of sheet product in accordance with one or more embodiments of the disclosure, as may be used with the sheet product dispensers disclosed herein.

FIG. 4 illustrates another wrapped roll 300 of sheet product according to one or more embodiments of the disclosure. The wrapped roll 300 may be used with the dispenser 100 or other sheet product dispensers. As shown, the wrapped roll 300 may include the roll 102 of sheet product described above and a wrapper 304 enclosing the roll 102. In this manner, the roll 102 may be contained within the wrapper 304 such that the wrapper 304 protects the roll 102 from potential contaminants during shipping, storage, and transport to the dispenser 100. Similar to the wrapped roll 200 described above, the wrapper 304 may be formed of a flexible polymer film, such as a low density polyethylene film, that provides moisture protection of the roll 102.

As shown, the wrapper 304 may include one or more flaps 306, which may be configured in a manner similar to the flaps 206 described above. The wrapper 304 also may include a tabbed portion 308 and one or more predefined areas of weakness 310, such as lines of perforations, extending along one or more edges of the tabbed portion 308. In this manner, the tabbed portion 308 may be attached to an adjacent portion of the wrapper 304 via the predefined areas of weakness. The tabbed portion 308 may be positioned about the circumferential outer surface of the roll 102, as shown. In some embodiments, the tabbed portion 308 has a generally triangular shape including a V-shaped leading edge extending to a tab 312 positioned about a center of the circumferential outer surface of the roll 102. Other suitable shapes of the tabbed portion 308 are possible.

As shown, one or more predefined areas of weakness 310, such as lines of perforations, may extend across the length of the wrapper 304 along the leading edge and the tab 312 of the tabbed portion. Based on this configuration, the tabbed portion 308 may be separated from the adjacent circumferential surface portion of the wrapper 304 by grasping the tab 312 and applying a separating force thereto until the predefined areas of weakness 310 along the tab 312 and the leading edge 312 are broken. One or more predefined areas of weakness 310, such as lines of perforations, also may extend along the circumferential edge at the intersection of one of the end surfaces of the roll 102 and the outer circumferential surface of the roll 102. In some embodiments, such predefined areas of weakness 310 may extend along a majority of the circumferential edge, such as 70 percent, 80 percent, or 90 percent thereof. Based on this configuration, after the tabbed portion 308 is initially separated from the adjacent circumferential surface portion of the wrapper 304, upon continued pulling thereof, the circumferential surface portion of the wrapper 304 may begin to separate from the end faces of the wrapper 304 as the predefined areas of weakness 310 along the circumferential edges are broken. Because the predefined areas of weakness 310 do not extend entirely around the circumferential edges, the end faces of the wrapper 304 may remain connected to the circumferential surface portion of the wrapper 304 after the predefined areas of weakness 310 are broken. In this manner, the entire wrapper 304 may be removed from the roll 102 as an integral unit.

In some embodiments, the tab 312 may be separate from the adjacent portion of the wrapper 304 (i.e., without a predefined area of weakness 310 therebetween) to facilitate grasping of the tab 312 and separation of the tabbed portion 308. In other embodiments, the tab 312 and the adjacent portion of the wrapper 304 may be connected by a predefined area of weakness 310 therebetween, and the wrapper 304 may include a label 314 positioned on the tab 312, as shown, to facilitate pulling of the tab 312. A leading end portion of the label 314, such as a leading half of the label 314, may be separate from the tab 312, and a trailing end portion of the label 314, such as a trailing half of the label 314, may be securely attached to the tab 312, for example by a glue, adhesive, or other bonding agent. Based on this configuration, a user may easily grasp and pull the leading end portion of the label 314 to facilitate pulling of the tab 312 and separation of the tab 312.

Figure 5A:
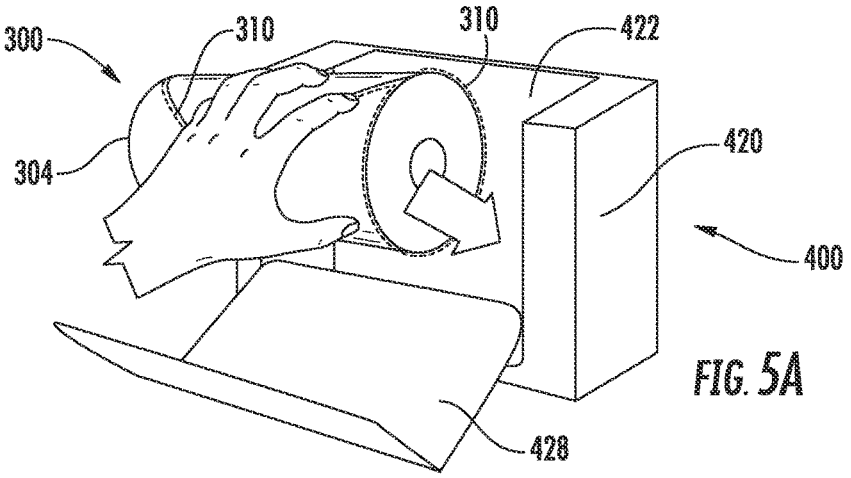
FIGS. 5A-5C are perspective views illustrating a method for loading the wrapped roll of sheet product of FIG. 4 in a sheet product dispenser in accordance with one or more embodiments of the disclosure.
Figure 5B:
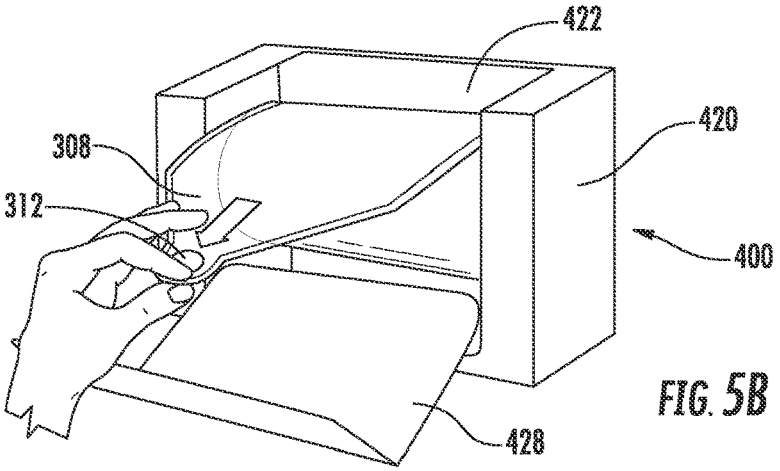
Figure 5C:
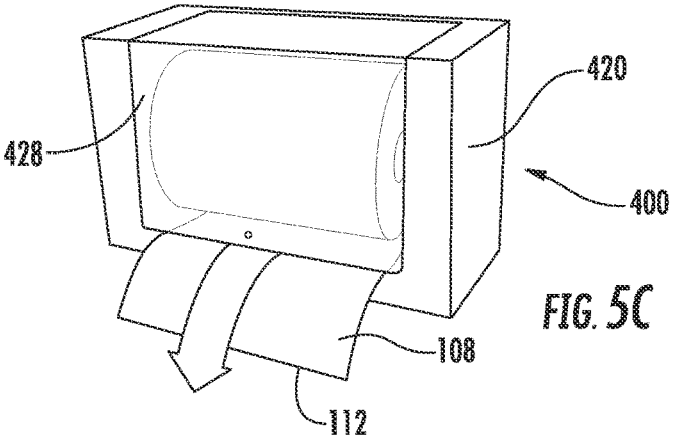

FIGS. 5A-5C illustrate a method for loading the wrapped roll 300 in a sheet product dispenser 400 according to one or more embodiments of the disclosure. The sheet product dispenser 400 may be configured in a manner similar to the dispenser 100, including features identical or similar to those described above with respect to the dispenser 100 (the features of dispenser 400 are indicated with corresponding reference numbers). The method may begin by moving a cover 428 to an open position and placing the wrapped roll 300 within an interior space 422 of the dispenser 400, as shown in FIG. 5A. Upon placing the wrapped roll 300 within the interior space 422, the wrapped roll 300 may be received within and supported by a cradle formed by a roll interface and a feed roller. The tab 312 of the tabbed portion 308 then may be grasped, and a separating force may be applied thereto by pulling the tab 312 away from the roll 102, thereby separating the tabbed portion 308 from the adjacent portion of the wrapper 304, as shown in FIG. 5B. Upon continued pulling of the tab 312, the entire wrapper 304 may be removed from the roll 102, while the roll 102 remains within the interior space 422 supported by the cradle. The roll may rotate within the interior space as the wrapper is removed therefrom. After removal of the wrapper 304, the roll 102 may be automatically loaded in the dispenser 400, as shown in FIG. 5C, according to the method described above.

The wrapped roll 300 and method for loading the wrapped roll 300 in the sheet product dispenser 400 advantageously may minimize exposure of the roll 102 to unsanitary conditions and potential contaminants during shipping, storage, and transport of the roll 102 to the dispenser 400 as well as loading the roll 102 in the dispenser 400. Additionally, the wrapped roll 300 may eliminate the risk of cross-contamination, as EVS personnel may handle the roll 102 only indirectly via the wrapper 304. In this manner, the wrapped roll 300 and method for loading may encourage hygienic practices, which may be particularly beneficial in medical environments.

Figure 6A:
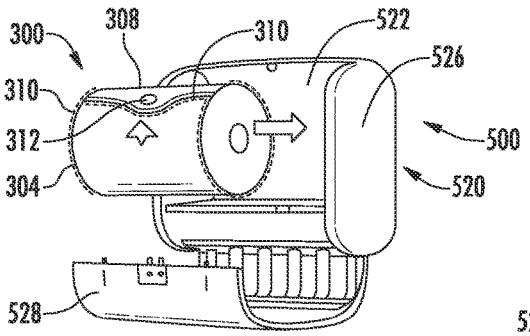
FIGS. 6A-6E are perspective views illustrating a method for loading the wrapped roll of sheet product of FIG. 4 in a sheet product dispenser in accordance with one or more embodiments of the disclosure.
Figure 6B:
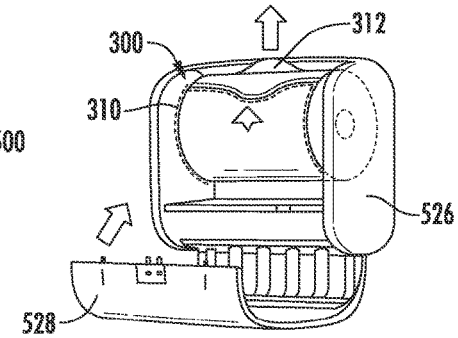
Figure 6C:
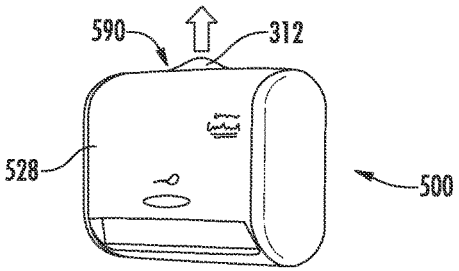
Figure 6D:
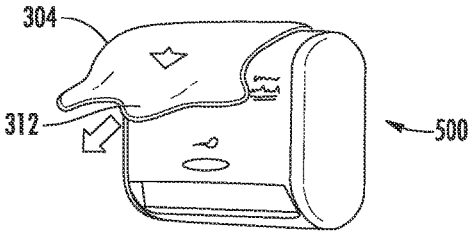
Figure 6E:
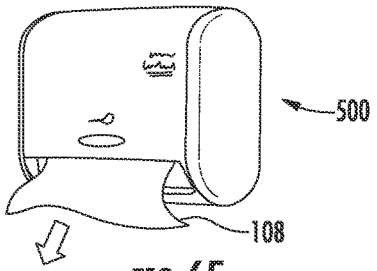

FIGS. 6A-6E illustrate another method for loading the wrapped roll 300 in a sheet product dispenser 500 according to one or more embodiments of the disclosure. The sheet product dispenser 500 may be configured in a manner similar to the dispenser 100, including features identical or similar to those described above with respect to the dispenser 100 (the features of dispenser 500 are indicated with corresponding reference numbers). The method may begin by moving a cover 528 to an open position and placing the wrapped roll 300 within an interior space 522 of the dispenser 500, as shown in FIG. 6A. Upon placing the wrapped roll 300 within the interior space 522, the wrapped roll 300 may be maintained within an upper portion of the interior space 522 with the tab 312 extending upward, as shown in FIG. 6B. For example, EVS personnel may hold the wrapped roll 300 via the tab 312, with the roll 102 positioned therebelow. As shown in FIG. 6C, the cover 528 then may be moved to a closed position with the tab 312 extending out of the housing 520. In some embodiments, the tab 312 may extend through a narrow access gap 590 between the adjacent portions of the base 526 and the cover 528. A seal may extend along the interface between the adjacent portions of the base 526 and the cover 528, which may be configured to seal the access gap 590 when the wrapper 304 is not extending therethrough. The tab 312 of the tabbed portion 308 then may be grasped, and a separating force may be applied thereto by pulling the tab 312 away from the roll 102, thereby separating the tabbed portion 308 from the adjacent portion of the wrapper 304. Upon continued pulling of the tab 312, the entire wrapper 304 may be removed from the roll 102 and from the dispenser 500, as shown in FIG. 6D. After removal of the wrapper 304, the roll 102 may be received within and supported by a cradle formed by a roll interface and a feed roller and may be automatically loaded in the dispenser 500, as shown in FIG. 6E, according to the method described above.

The wrapped roll 300 and method for loading the wrapped roll 300 in the sheet product dispenser 500 advantageously may eliminate exposure of the roll 102 to unsanitary conditions and potential contaminants during shipping, storage, and transport of the roll 102 to the dispenser 500 as well as loading the roll 102 in the dispenser 500. Additionally, the wrapped roll 300 may eliminate the risk of cross-contamination, as EVS personnel may handle the roll 102 only indirectly via the wrapper 304. In this manner, the wrapped roll 300 and method for loading may encourage hygienic practices, which may be particularly beneficial in medical environments.

Figure 7A:
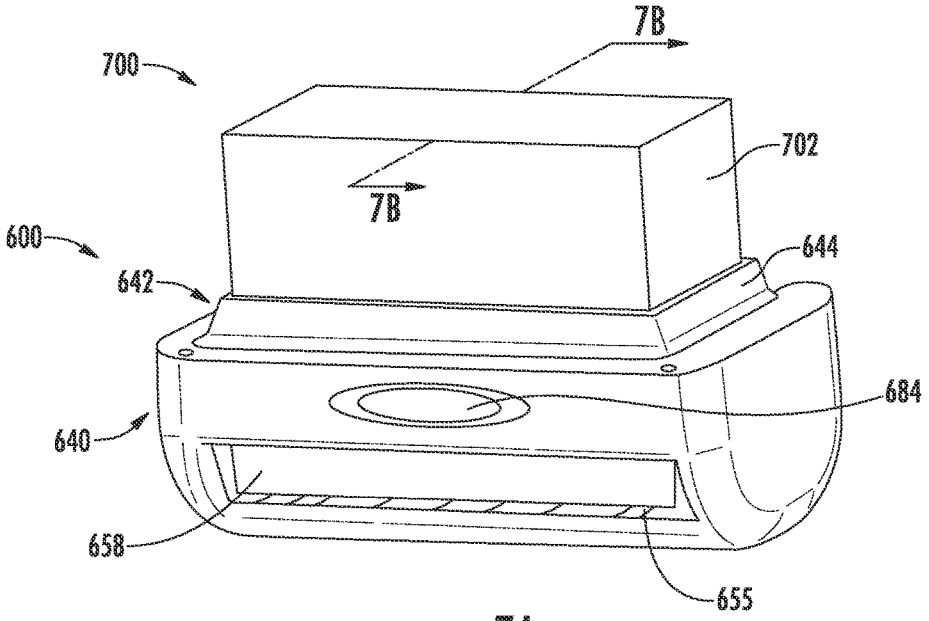
FIG. 7A is a perspective view of a sheet product dispenser and a cartridge in accordance with one or more embodiments of the disclosure.
Figure 7B:
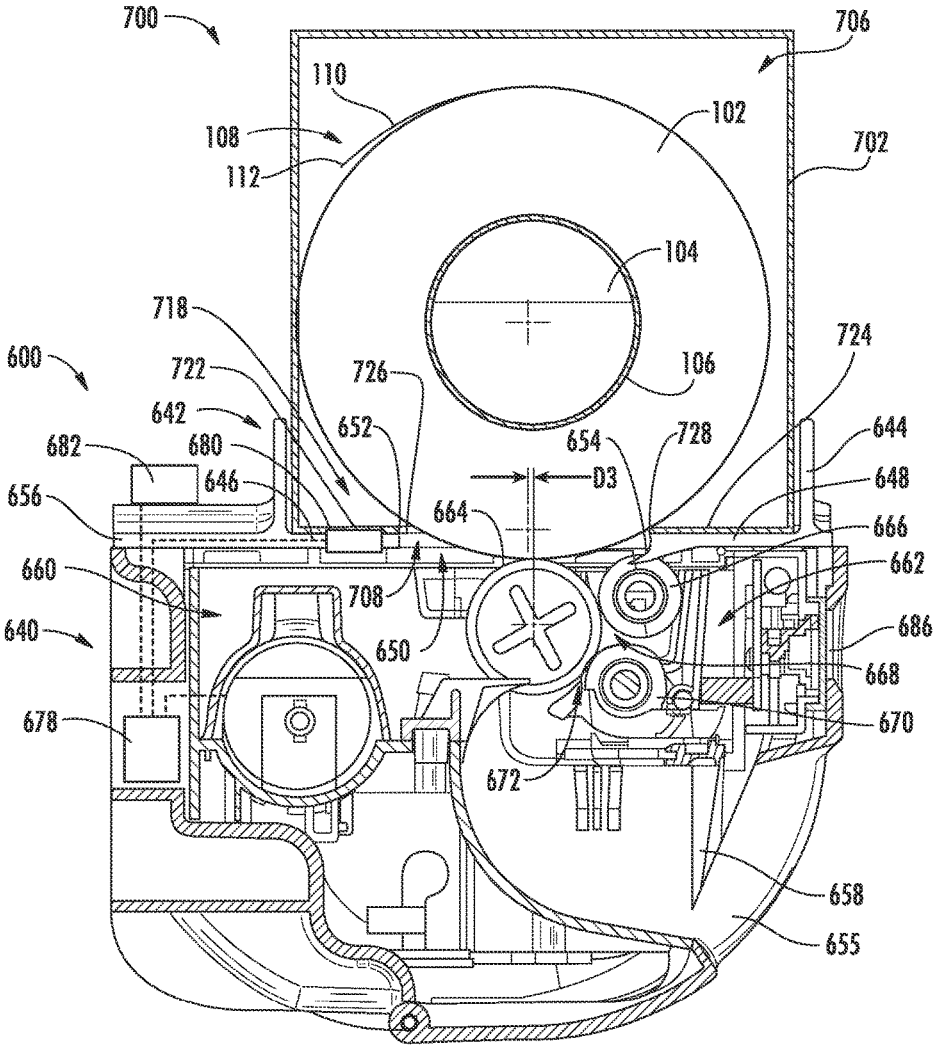
FIG. 7B is a side cross-sectional view of the sheet product dispenser and the cartridge of FIG. 7A taken along line 7B-7B, showing the cartridge and a roll of sheet product therein after initial engagement of the cartridge and the sheet product dispenser.
Figure 7C:
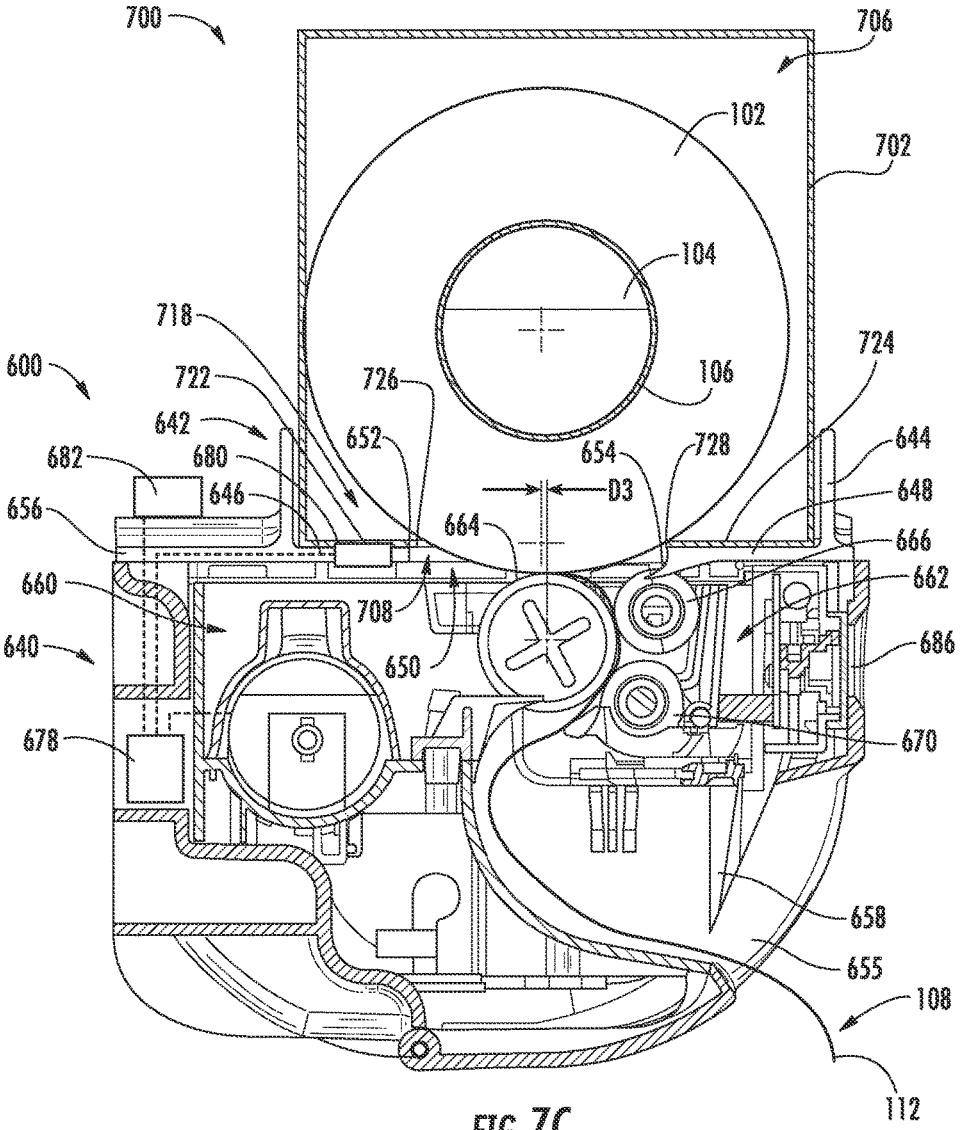
FIG. 7C is a side cross-sectional view of the sheet product dispenser of FIG. 7A, similar to the view of FIG. 7B, showing the roll of sheet product after automatic loading of the roll in the sheet product dispenser.

FIGS. 7A-7C illustrate another sheet product dispenser 600 (which also may be referred to as an "auto-loading sheet product dispenser") according to one or more embodiments of the disclosure. The dispenser 600 is configured to allow a user to obtain a length of sheet product from the roll 102 of sheet product contained within a cartridge 700 supported by the dispenser 600. As described in detail below, the dispenser 600 is configured to automatically load the roll 102 of sheet product when the cartridge 700 is placed on the dispenser 600. The combination of the sheet product dispenser 600 and the cartridge 700 may form a sheet product dispenser system.

Figure 8A:
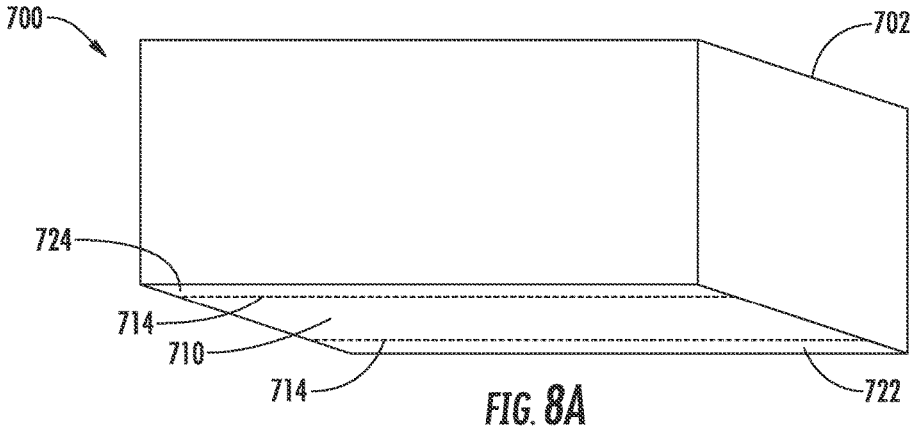
FIG. 8A is a perspective view of a cartridge in accordance with one or more embodiments of the disclosure, as may be used with the sheet product dispensers disclosed herein.
Figure 8B:
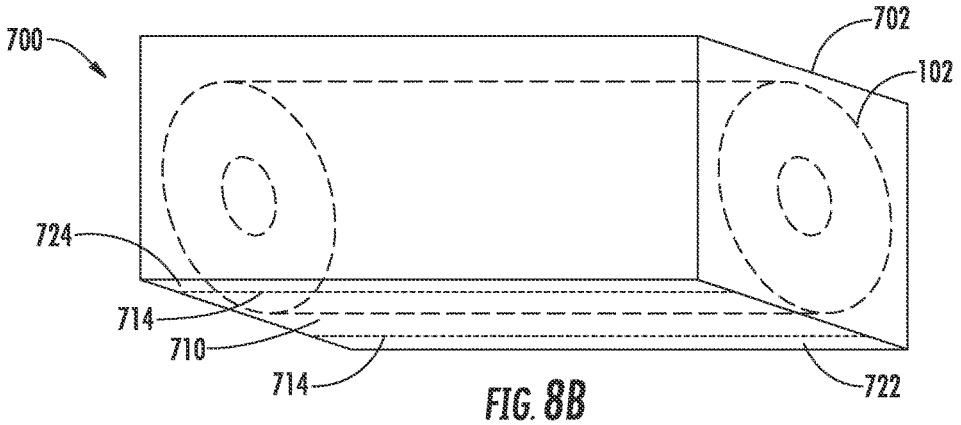
FIG. 8B is a perspective view of the cartridge of FIG. 8A, showing a roll of sheet product contained therein.
Figure 8C:
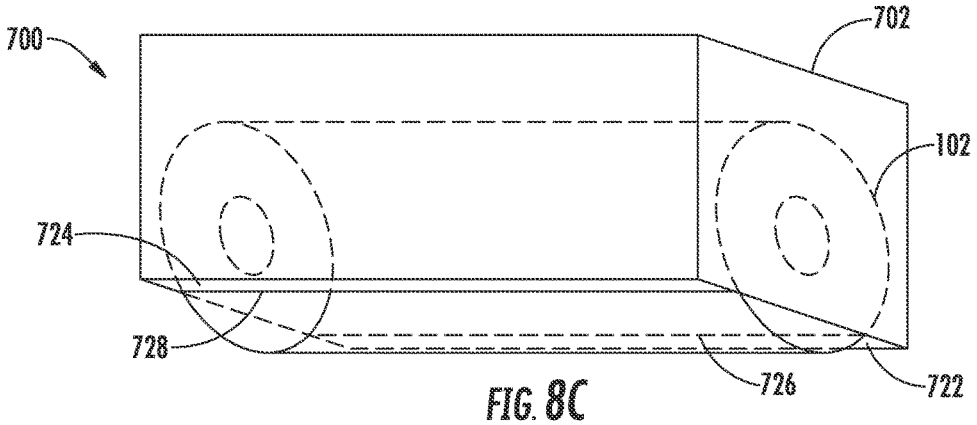
FIG. 8C is a perspective view of the cartridge of FIG. 8A, showing a dispensing opening exposed and the roll of sheet product extending therethrough.

FIGS. 8A-8C illustrate the cartridge 700 according to one or more embodiments of the disclosure. The cartridge 700 may include a housing 702 (which also may be referred to as a "carton"). During shipping, storage, and transport of the cartridge 700 to the dispenser 600, the roll 102 may be enclosed within the housing 702 and protected thereby. As shown, the roll 102 may be loose within the housing 702 (i.e., the roll 102 is not supported by roll holders or other structure within the housing 702). The housing 702 may include a plurality of walls and may define an interior space 706 inward of the walls and configured to receive the roll 102 therein. Prior to use of the cartridge 700, the interior space 706 may be completely closed by the housing 702, as shown in FIGS. 8A and 8B, although certain gaps or openings may be selectively exposed for use of the cartridge 700 with the dispenser 600. In particular, the housing 702 may include a cartridge opening 708 (which also may be referred to as a "dispensing opening") defined in one or more of the walls and configured to allow the sheet product to pass therethrough when the cartridge opening 708 is exposed. As shown, the cartridge opening 708 may be defined in the bottom wall of the housing 702, although other locations of the cartridge opening 708 may be used. During use of the cartridge 700, the sheet product may be directed through the cartridge opening 708, out of the housing 702, and into the dispenser 600, as described below.

The housing 702 may include a removable portion 710 that may be removed from a remainder of the housing 702 to selectively expose the cartridge opening 708 for use of the cartridge 700. In some embodiments, as shown, the removable portion 710 is integrally formed with a remainder of the housing 702, and the housing 702 includes one or more predefined areas of weakness 714, such as lines of perforations, extending along one or more edges of the removable portion 710. The removable portion 710 may be attached to an adjacent portion of the housing 702, such as a remainder of the bottom wall of the housing 702, via the predefined areas of weakness 714. In this manner, the cartridge opening 708 may be defined by the removable portion 710 and may be exposed upon removal of the removable portion 710 by tearing the predefined areas of weakness 714. In other embodiments, the removable portion 710 is separately formed from and attached to a remainder of the housing 702, such that the cartridge opening 708 is covered by the removable portion 710. The removable portion 710 may be attached to an adjacent portion of the housing 702 via a glue, adhesive, or other bonding agent. In this manner, the cartridge opening 708 may be exposed upon removal of the removable portion 710 by peeling or otherwise detaching the removable portion 710 from the adjacent portion of the housing 702.

As shown, the cartridge 700 may include a roll interface 718 configured to engage and at least partially support the roll 102 of sheet product upon removal of the removable portion 710. The roll interface 718 may include a first member 722 (which also may be referred to as a "folding member" for reasons described below) and a second member 724 (which also may be referred to as a "separating member" for reasons described below). The first member 722 and the second member 724 may be spaced apart from one another to define the cartridge opening 708 (which also may be referred to as a "roll interface opening") therebetween, as exposed upon removal of the removable portion 710. As shown, the cartridge opening 708 may extend along the length of the housing 702 and may be configured to allow a portion of the roll 102 to extend therethrough. The first member 722 may be positioned along a back portion of the housing 702, and the second member 724 may be positioned along a front portion of the housing 702, as shown. In this manner, as shown in FIG. 8C, the first member 722 may be configured to engage a back, lower portion of the roll 102, and the second member 724 may be configured to engage a front, lower portion of the roll 102 when the roll 102 extends through the cartridge opening 708.

As shown, the first member 722 may have an elongated shape including a first edge 726 extending along the back of the cartridge opening 708 and configured to engage the back, lower portion of the roll 102. In a similar manner, the second member 724 may have an elongated shape including a second edge 728 extending along the front of the cartridge opening 708 and configured to engage the front, lower portion of the roll 102. For example, the first member 722 and the second member 724 may be shaped as blades. In some embodiments, the first member 722 and the second member 724 are part of the housing 702, as shown. In other embodiments, the first member 722 and the second member 724 are formed separately from and attached to the housing 702. For example, the first member 722 and the second member 724 may be attached to the housing 702 by a glue, adhesive, or other bonding agent.

As shown in FIGS. 7A-7C, the sheet product dispenser 600 may include a dispenser chassis 640 configured to support the cartridge 700. Specifically, the dispenser chassis 640 may include a cartridge interface 642 configured to engage and support the cartridge 700 such that the sheet product may pass from the roll 102, out of the cartridge 700, and into the dispenser 600. The cartridge interface 642 may include a lip 644 (which also may be referred to as a "border") configured to engage and surround a portion of the cartridge 700. As shown, the lip 644 may extend upward and may engage and surround a bottom portion of the cartridge 700, such that the lip 644 prevents lateral movement of the cartridge 700 relative to the chassis 640. In some embodiments, an outer surface of the lip 644 may be angled upward toward the cartridge 700.

The cartridge interface 642 also may include a first support member 646 (which also may be referred to as a "folding member" in some embodiments for reasons described below) and a second support member 648 (which also may be referred to as a "separating member" in some embodiments for reasons described below) that are spaced apart from one another to define a chassis opening 650 (which also may be referred to as a "cartridge interface opening") therebetween. As shown, the chassis opening 650 may extend along a length of the chassis 640 and may be in communication with the cartridge opening 708. The chassis opening 640 may be configured to allow a portion of the roll 102 to extend therethrough when cartridge 700 engages the cartridge interface 642 and the cartridge opening 708 is exposed. Thus, at least one of the cartridge and the sheet product dispenser include a separating member and/or a folding member configured to engage and unseal the sealed tail. In certain embodiments, both the cartridge and the sheet product dispenser include a separating member and/or a folding member configured to engage and unseal the sealed tail.

The first support member 646 may be positioned along a back portion of the chassis 640, and the second support member 648 may be positioned along a front portion of the chassis 640, as shown. In this manner, the first support member 646 may be configured to engage and support the first member 722 of the cartridge 700, and the second support member 648 may be configured to engage and support the second member 724 of the cartridge 700. As shown in FIGS. 7B and 7C, the width of the chassis opening 650 may be larger than the width of the cartridge opening 708, such that a portion of the first member 722 extends over the chassis opening 650 toward the front of the dispenser 600 and a portion of the second member 724 extends over the chassis opening 650 toward the back of the dispenser 600. Alternatively, the width of the chassis opening 650 may be smaller than the width of the cartridge opening 708, such that a portion of the first support member 646 extends under the cartridge opening 708 toward the front of the dispenser 600 and a portion of the second support member 648 extends under the cartridge opening 708 toward the back of the dispenser 600.

According to embodiments in which the width of the chassis opening 650 is smaller than the width of the cartridge opening 708, the first support member 646 may have an elongated shape including a first edge 652 extending along the back of the chassis opening 650 and configured to engage the back, lower portion of the roll 102, and the second support member 648 may have an elongated shape including a second edge 654 extending along the front of the chassis opening 650 and configured to engage the front, lower portion of the roll 102. For example, the first support member 646 and the second support member 648 may be shaped as blades. One or both of the first edge 652 and the second edge 654 may be a sharp edge. Alternatively, one or both of the first edge 652 and the second edge 654 may be rounded, serrated, knurled, textured, or otherwise shaped to enhance friction between the respective portion of the roll 102 and the first support member 646 or the second support member 648.

As shown, the dispenser chassis 640 may include a dispenser opening 655 defined therein and configured to allow the sheet product to be dispensed therethrough and out of the dispenser 600. As shown, the dispenser opening 655 may be defined in a lower, front portion of a frame 656 of the chassis 640, although other locations of the dispenser opening 655 may be used. The chassis 640 also may include a tear bar 658 positioned about the dispenser opening 655 and configured to facilitate tearing of a length of sheet product from the roll 102. In some embodiments, the tear bar 658 is formed separately from and attached to the frame 656 of the chassis 640. In other embodiments, the tear bar 658 is integrally formed with the frame 656, as shown. During use of the dispenser 600, the sheet product may be directed through the dispenser opening 630 and out of the chassis 640, such that the sheet product may be easily grasped by a user and removed via the tear bar 658. The illustrated tear bar is not intended to be limiting. Rather, the tear bar may be any known tear bar configuration known in the art.

As shown in FIGS. 7B and 7C, the sheet product dispenser 600 also may include a dispensing mechanism 660 configured to dispense the sheet product from the roll 102 and direct the sheet product out of the dispenser opening 655. The dispensing mechanism 660 may include a feed roller assembly 662 disposed within the dispenser chassis 640 and configured to dispense the sheet product from the roll 102. The feed roller assembly 662 may include a feed roller 664 (which also may be referred to as a "drive roller") and a first pinch roller 666 (which also may be referred to as an "upper pinch roller") defining a first nip 668 (which also may be referred to as an "in-running nip") therebetween for receiving and advancing the sheet product. The feed roller assembly 662 also may include a second pinch roller 670 (which also may be referred to as a "lower pinch roller") defining a second nip 672 (which also may be referred to as an "out-running nip") between the feed roller 664 and the second pinch roller 670 for receiving and advancing the sheet product. In some embodiments, the feed roller assembly 662 does not include the second pinch roller 670.

As shown, the feed roller 664 may be disposed below the cartridge opening 708 and the chassis opening 650 and configured to engage and at least partially support the bottom portion of the roll 102 of sheet product. In this manner, according to embodiments in which the width of the chassis opening 650 is larger than the width of the cartridge opening 708, the first member 722, the second member 722, and the feed roller 664 may collectively form a cradle for receiving and supporting the roll 102. Alternatively, according to embodiments in which the width of the chassis opening 650 is smaller than the width of the cartridge opening 708, the first support member 646, the second support member 648, and the feed roller 664 may collectively form a cradle for receiving and supporting the roll 102. The dispensing mechanism 660 may include a motor 674 in operable communication with the feed roller 664 and configured to selectively drive the feed roller 664. In particular, the motor 674 may be in communication with the feed roller 664 via one or more gears in a manner similar to that shown and described above with respect to dispenser 100. The motor 674 also may be in operable communication with a controller 678 of the dispenser 600, which may be configured to selectively activate the motor 674.

The controller 678 may be in operable communication with a cartridge sensor 680 configured to detect initial engagement between the cartridge interface 642 and the cartridge 700. Based on this configuration, the controller 678 may be operable to activate the motor 674, thereby initiating driving of the feed roller 664, in response to the cartridge interface 642 initially engaging the cartridge 700 as detected by the cartridge sensor 680. The cartridge sensor 680 may be a proximity sensor, a pressure sensor, or other type of sensor configured to detect initial placement of the cartridge 700 on the cartridge interface 642. Additionally or alternatively, the controller 678 may be operable to activate the motor 674, thereby initiating driving of the feed roller 664, in response to manual activation of an input device 682, such as a button or switch, in communication with the controller 678. The controller 678 also may be in operable communication with a user proximity sensor 684 configured to detect the presence of a user's hand proximate the dispenser 600. Based on this configuration, the controller 678 may be operable to activate the motor 674, thereby initiating driving of the feed roller 664, in response to placement of a user's hand proximate the dispenser 600 as detected by the user proximity sensor 684.

As noted above, the dispenser 600 is configured to automatically load the roll 102 of sheet product when the cartridge 700 is placed on the dispenser 600. A method for automatically loading the roll 102 in the dispenser 600 may begin by removing the removable portion 710 of the housing 702 and placing the cartridge 700 on the dispenser 600 such that the cartridge interface 642 engages and supports the cartridge 700. As shown in FIG. 7B, the cartridge 700 may be placed on the dispenser 600 in an orientation such that the free distal end 112 of the sealed tail 108 of the roll 102 extends in the direction of rotation of the roll 102. Although the roll 102 is shown positioned in the cartridge 700 such that the sealed tail 108 is positioned about the back, upper portion of the roll 102, the roll 102 may be positioned such that the sealed tail 108 is at any radial position with respect to the longitudinal axis of the roll 102.

According to embodiments in which the width of the chassis opening 650 is larger than the width of the cartridge opening 708, upon placing the cartridge 700 on the dispenser 600, the roll 102 may be received within and supported by the cradle formed by the roll interface 718 and the feed roller 664, as shown. In some embodiments, in response to the cartridge interface 642 initially engaging the cartridge 700, the dispenser 600 may rotate the roll 102 (in the counter-clockwise direction according to the view of FIG. 7B). Specifically, in response to the cartridge interface 642 initially engaging the cartridge 700 as detected by the cartridge sensor 680, the controller 678 may activate the motor 674, thereby driving the feed roller 664 and rotating the roll 102. In other embodiments, in response to manual activation of the input device 682, the dispenser 600 may rotate the roll 102 (in the counter-clockwise direction according to the view of FIG. 7B). Specifically, in response to manual activation of the input device 682, the controller 678 may activate the motor 674, thereby driving the feed roller 664 and rotating the roll 102.

Upon rotation of the roll 102 of sheet product, the free distal end 112 of the sealed tail 108 may engage the second member 724, in particular the second edge 728 thereof, which may cause the free distal end 112 of the sealed tail 108 to be unsealed. Alternatively, upon rotation of the roll 102 of sheet product, the free distal end 112 of the sealed tail 108 may engage the first member 722, in particular the first edge 726 thereof, which may cause the free distal end 112 to be folded over. Specifically, the first edge 726 may fold the free distal end 112 of the sealed tail 108 at least partially back over the sealed region 110. Upon further rotation of the roll 102, the sealed region 110 of the sealed tail 108 may engage the second member 724, in particular the second edge 728 thereof, which may cause the sealed tail 108 to unseal from the remainder of the roll 102. Specifically, the second edge 728 may unseal the sealed region 110, thereby separating the tail 108 from the adjacent layer of sheet product. Notably, use of the first member 722 and the second member 724 of the disposable cartridge 700 to fold over and unseal the tail 108 advantageously may reduce wear on the dispenser 600. Upon further rotation of the roll 102, the second member 724, in particular the second edge 728 thereof, may direct the unsealed tail 108 downward into the feed roller assembly 662. Specifically, the second member 724 may direct the unsealed tail 108 into the first nip 668. The controller 678 may continue to drive the feed roller 664 via the motor 674 such that the tail 108 is fed through the feed roller assembly 662 and out of the dispenser opening 655, as shown in FIG. 7C. In some embodiments, the controller 678 may deactivate the motor 674 and thus stop driving of the feed roller 664 upon expiration of a timer of the controller 678. In other embodiments, the controller 678 may deactivate the motor 674 and thus stop driving of the feed roller 164 in response to a sensor detecting that a length of sheet product including the unsealed tail 108 has extended out of the dispenser opening 655. The extended length of sheet product may be grasped by EVS personnel and removed from the roll 102, as may be facilitated by the tear bar 658. The loading process may be complete upon removal of the extended length of sheet product, such that the dispenser 100 is ready for dispensing the sheet product from the roll 102.

In a similar manner, according to embodiments in which the width of the chassis opening 650 is smaller than the width of the cartridge opening 708, upon placing the cartridge 700 on the dispenser 600, the roll 102 may be received within and supported by the cradle formed by the first support member 646, the second support member 648, and the feed roller 664. The roll 102 may be rotated either in response to the cartridge interface 642 initially engaging the cartridge 700 or in response to manual activation of the input device 682. Upon rotation of the roll 102, the sealed tail 108 may engage the first support member 646, in particular the first edge 652 thereof, which may cause the sealed tail 108 to be folded over. Upon further rotation of the roll 102, the sealed tail 108 may engage the second support member 648, in particular the second edge 654 thereof, which may cause the sealed tail 108 to unseal from the remainder of the roll 102. Upon further rotation of the roll 102, the second support member 648, in particular the second edge 654 thereof, may direct the unsealed tail 108 downward into the feed roller assembly 662. The controller 678 may continue to drive the feed roller 664 via the motor 674 such that the unsealed tail 108 is fed through the feed roller assembly 662 and out of the dispenser opening 655. The extended length of sheet product may be grasped by EVS personnel and removed from the roll 102, such that the dispenser 100 is ready for dispensing the sheet product from the roll 102.

Dispensing of a length of the sheet product from the roll 102 for an end user may be carried out in a conventional manner. Specifically, in response to placement of a user's hand proximate the dispenser 600 as detected by the user proximity sensor 684, the controller 678 may activate the motor 674, thereby driving the feed roller 664 and advancing a length of the sheet product out of the dispenser opening 655 for the user to grasp and remove from the roll 102. In some embodiments, other means of activating the motor 674 may be used. In some embodiments, as the outer diameter OD of the roll 102 decreases due to removal of the sheet product, the roll 102 may move to the back side of the feed roller 664 (and to the back portion of the cartridge 700). According to embodiments in which the width of the chassis opening 650 is larger than the width of the cartridge opening 708, such movement may cause the roll 102 to disengage the second member 724, such that the roll 102 is supported by only the first member 722 and the feed roller 664. According to embodiments in which the width of the chassis opening 650 is smaller than the width of the cartridge opening 708, such movement may cause the roll 102 to disengage the second support member 648, such that the roll 102 is supported by only the first support member 646 and the feed roller 664.

The movement of the roll 102 and disengagement of the second member 724 (or the first member 722) or the second support member 648 (or the first support member) (646) beneficially may reduce dust generation that otherwise would be caused by the second member 724 (or the first member 722) or the second support member 648 (or the first support member) constantly scraping against the roll 102 throughout the life of the roll 102. According to embodiments in which the width of the chassis opening 650 is larger than the width of the cartridge opening 708, the movement of the roll 102 and disengagement of the second member 724 may be achieved by positioning the feed roller 664 such that the longitudinal axis of the feed roller 664 is offset from the longitudinal axis of the roll 102 by a distance D3, as shown. In a similar manner, according to embodiments in which the width of the chassis opening 650 is smaller than the width of the cartridge opening 708, the movement of the roll 102 and disengagement of the second support member 648 may be achieved by positioning the feed roller 664 such that the longitudinal axis of the feed roller 664 is offset from the longitudinal axis of the roll 102.

In other embodiments, the roll 102 may be located to the front side of the feed roller 664. This may be caused by locating the roll 102 such that it is supported solely by the feed roller 664 and the second member 724, or by a decrease in the outer diameter OD of the roll 102 and disengagement of the first member 722 or first support member 646, depending on the relative widths of the chassis opening and cartridge opening. According to embodiments in which the width of the chassis opening 650 is larger than the width of the cartridge opening 708, such movement may cause the roll 102 to disengage the first member 722, such that the roll 102 is supported by only the second member 724 and the feed roller 664. According to embodiments in which the width of the chassis opening 650 is smaller than the width of the cartridge opening 708, such movement may cause the roll 102 to disengage the first support member 646, such that the roll 102 is supported by only the second support member 648 and the feed roller 664. In some embodiments, the forward location of the roll 102 and/or disengagement of the first member 722 or first support member 646 may be achieved by positioning the feed roller 664 such that the longitudinal axis of the feed roller 664 is offset from the longitudinal axis of the roll 102 by a distance in back of the longitudinal axis of the roll 102. In this manner, according to such embodiments, the feed roller 664 would offset from the longitudinal axis of the roll 102 in an opposite manner as compared to that shown in FIGS. 7B and 7C.

The sheet product dispenser 600 and method for automatically loading the roll 102 in the dispenser 600 advantageously may simplify the loading process as compared to existing dispensers and methods. In particular, the dispenser 600 and method may reduce the time and effort required on the part of EVS personnel by eliminating the need to manually unseal the sealed tail 108 and positioning the unsealed tail 108 in a certain manner with respect to the dispensing mechanism 660. As described above, these steps may be performed automatically by the dispenser 600 either upon the cartridge interface 642 initially engaging the cartridge or upon manual activation of the input device 682. Moreover, the cartridge 700 advantageously may minimize exposure of the roll 102 to unsanitary conditions and potential contaminants during shipping, storage, and transport of the cartridge 700 to the dispenser 600 as well as loading the roll 102 in the dispenser 600. Additionally, the cartridge 700 may eliminate the risk of cross-contamination, as EVS personnel may handle the roll 102 only indirectly via the housing 702. In this manner, the dispenser 600, the cartridge 700, and the method for loading may encourage hygienic practices, which may be particularly beneficial in medical environments.

Embodiments of the present disclosure further include any one or more of the following paragraphs:

1. A sheet product dispenser for dispensing sheet product from a roll of sheet product having a sealed tail, the dispenser comprising:

a roll interface configured to engage and at least partially support the roll of sheet product, the roll interface comprising a separating member configured to engage and unseal the sealed tail;

a feed roller assembly configured to dispense sheet product from the roll of sheet product, the feed roller assembly comprising a feed roller configured to engage and at least partially support the roll of sheet product; and a controller operable to initiate driving of the feed roller and rotation of the roll of sheet product such that the sealed tail is unsealed by engaging the separating member.

2. The sheet product dispenser of paragraph 1, wherein the controller is operable to initiate driving of the feed roller and rotation of the roll of sheet product in response to the roll interface initially engaging the roll of sheet product.
3. The sheet product dispenser of paragraph 2, further comprising a roll sensor in communication with the controller, the roll sensor configured to detect initial engagement between the roll interface and the roll of sheet product.
4. The sheet product dispenser of paragraph 3, wherein the roll sensor comprises a proximity sensor or a pressure sensor.
5. The sheet product dispenser of paragraph 1, further comprising an input device, wherein the controller is operable to initiate driving of the feed roller and rotation of the roll of sheet product in response to manual activation of the input device.
6. The sheet product dispenser of paragraph 5, wherein the input device comprises a button or a switch.
7. The sheet product dispenser of paragraph 1, wherein the roll interface further comprises a roll interface opening configured to allow a portion of the roll of sheet product to extend therethrough and engage the feed roller.
8. The sheet product dispenser of paragraph 7, wherein the feed roller is positioned below the roll interface opening.
9. The sheet product dispenser of paragraph 8, wherein a longitudinal axis of the feed roller is offset from a centerline longitudinal axis of the roll interface opening.
10. The sheet product dispenser of paragraph 7, wherein the roll interface further comprises a folding member configured to engage and fold the sealed tail.
11. The sheet product dispenser of paragraph 10, wherein the separating member and the folding member are spaced apart from one another to define the roll interface opening therebetween.
12. The sheet product dispenser of paragraph 1, wherein the separating member comprises a blade comprising an edge configured to engage and unseal the sealed tail.
13. The sheet product dispenser of paragraph 1, wherein the separating member is further configured to direct the unsealed tail into the feed roller assembly, and wherein the controller is operable to initiate driving of the feed roller and rotation of the roll of sheet product, such that the sealed tail is unsealed by engaging the separating member and the unsealed tail is directed into the feed roller assembly by engaging the separating member.
14. The sheet product dispenser of paragraph 1, further comprising a housing defining an interior space configured to receive the roll of sheet product therein.
15. The sheet product dispenser of paragraph 14, wherein the housing comprises a base and a cover movably connected to the base and configured to move from an open position to a closed position.
16. A method of automatically loading a roll of sheet product having a sealed tail in a sheet product dispenser, the method comprising:

engaging the roll of sheet product with a roll interface and a feed roller of the sheet product dispenser;

initiating driving of the feed roller and rotation of the roll of sheet product; and unsealing the sealed tail by rotating the roll of sheet product such that the sealed tail engages a separating member of the roll interface.

17. The method of paragraph 16, wherein initiating driving of the feed roller and rotation of the roll of sheet product occurs in response to the roll interface initially engaging the roll of sheet product.
18. The method of paragraph 17, further comprising detecting initial engagement between the roll interface and the roll of sheet product via a roll sensor of the sheet product dispenser.
19. The method of paragraph 16, wherein initiating driving of the feed roller and rotation of the roll of sheet product occurs in response to manual activation of an input device of the sheet product dispenser.
20. The method of paragraph 16, wherein engaging the roll of sheet product with the roll interface and the feed roller comprises allowing a portion of the roll of sheet product to extend through a roll interface opening of the roll interface and engage the feed roller.
21. The method of paragraph 16, further comprising folding the sealed tail by rotating the roll of sheet product such that the sealed tail contacts a folding member of the roll interface.
22. The method of paragraph 16, wherein the separating member comprises a blade, and wherein unsealing the sealed tail comprises rotating the roll of sheet product such that the sealed tail contacts an edge of the blade.

23. The method of paragraph 16, further comprising feeding the unsealed tail through a feed roller assembly of the sheet product dispenser, the feed roller assembly comprising the feed roller and a pinch roller.

24. The method of paragraph 23, further comprising directing the unsealed tail into the feed roller assembly via the separating member.

25. The method of paragraph 16, wherein the sealed tail is sealed to an adjacent layer of sheet product by a glue, adhesive, or other bonding agent.

26. The method of paragraph 16, further comprising placing the roll of sheet product within a housing of the sheet product dispenser.

27. The method of paragraph 26, further comprising removing a wrapper from the roll of sheet product after placing the roll of sheet product within the housing.

28. The method of paragraph 27, wherein the wrapper comprises a tabbed portion and a predefined area of weakness extending along the tabbed portion, and wherein removing the wrapper from the roll of sheet product comprises pulling the tabbed portion.

29. The method of paragraph 27, wherein the housing comprises a cover configured to move from an open position to a closed position, and wherein removing the wrapper from the roll of sheet product comprises removing the wrapper from the roll of sheet product while the cover is in the closed position.

30. The method of paragraph 27, wherein the wrapper comprises a polymer film.

31. A sheet product dispenser system for dispensing sheet product from a roll of sheet product having a sealed tail, the system comprising:

a cartridge configured to contain the roll of sheet product therein, at least one of the cartridge and the sheet product dispenser comprising a separating member configured to engage and unseal the sealed tail;

a sheet product dispenser comprising:

a cartridge interface configured to engage and support the cartridge;

a feed roller assembly configured to dispense sheet product from the roll of sheet product, the feed roller assembly comprising a feed roller configured to engage and at least partially support the roll of sheet product; and a controller operable to initiate driving of the feed roller and rotation of the roll of sheet product such that the sealed tail is unsealed by engaging the separating member.

32. The sheet product dispenser system of paragraph 31, wherein the controller is operable to initiate driving of the feed roller and rotation of the roll of sheet product in response to the cartridge interface initially engaging the cartridge.

33. The sheet product dispenser system of paragraph 32, wherein the sheet product dispenser further comprises a cartridge sensor in communication with the controller, the cartridge sensor configured to detect initial engagement between the cartridge interface and the cartridge.

34. The sheet product dispenser system of paragraph 31, wherein the sheet product dispenser further comprises an input device, wherein the controller is operable to initiate driving of the feed roller and rotation of the roll of sheet product in response to manual activation of the input device.

35. The sheet product dispenser system of paragraph 31, wherein the cartridge comprises a roll interface configured to engage and at least partially support the roll of sheet product, the roll interface comprising the separating member and a roll interface opening configured to allow a portion of the roll of sheet product to extend therethrough and engage the feed roller.

36. The sheet product dispenser system of paragraph 35, wherein the roll interface further comprises a removable portion configured to be removed to expose the roll interface opening.

37. The sheet product dispenser system of paragraph 36, wherein the removable portion is removably attached to an adjacent portion of the cartridge via a predefined area of weakness.

38. The sheet product dispenser of paragraph system 35, wherein the roll interface further comprises a folding member configured to engage and fold the sealed tail.

39. The sheet product dispenser system of paragraph 38, wherein the separating member and the folding member are spaced apart from one another to define the roll interface opening therebetween.

40. The sheet product dispenser system of paragraph 31, wherein the separating member is further configured to direct the unsealed tail into the feed roller assembly, and wherein the controller is operable to initiate driving of the feed roller and rotation of the roll of sheet product, such that the sealed tail is unsealed by engaging the separating member and the unsealed tail is directed into the feed roller assembly by engaging the separating member.

41. A method of automatically loading a roll of sheet product having a sealed tail in a sheet product dispenser, the method comprising:

engaging a cartridge containing the roll of sheet product with a cartridge interface of the sheet product dispenser;

engaging the roll of sheet product with a roll interface of the cartridge and a feed roller of the sheet product dispenser;

initiating driving of the feed roller and rotation of the roll of sheet product; and unsealing the sealed tail by rotating the roll of sheet product such that the sealed tail engages a separating member of the roll interface.

42. The method of paragraph 41, wherein initiating driving of the feed roller and rotation of the roll of sheet product occurs in response to the cartridge interface initially engaging the cartridge.

43. The method of paragraph 42, further comprising detecting initial engagement between the cartridge interface and the cartridge via a cartridge sensor of the sheet product dispenser.

44. The method of paragraph 41, wherein initiating driving of the feed roller and rotation of the roll of sheet product occurs in response to manual activation of an input device of the sheet product dispenser.

45. The method of paragraph 41, wherein engaging the roll of sheet product with the roll interface and the feed roller comprises allowing a portion of the roll of sheet product to extend through a roll interface opening of the roll interface and engage the feed roller.

46. The method of paragraph 45, further comprising removing a removable portion of the cartridge to expose the roll interface opening.

47. The method of paragraph 46, wherein removing the removable portion comprises tearing a predefined area of weakness extending along the removable portion.

48. The method of paragraph 41, further comprising folding the sealed tail by rotating the roll of sheet product such that the sealed tail contacts a folding member of the roll interface.

49. The method of paragraph 41, further comprising feeding the unsealed tail through a feed roller assembly of the sheet product dispenser, the feed roller assembly comprising the feed roller and a pinch roller.

50. The method of paragraph 41, wherein the sealed tail is sealed to an adjacent layer of sheet product by a glue, adhesive, or other bonding agent.

51. A method of automatically loading a roll of sheet product having a sealed tail in a sheet product dispenser, the method comprising:

placing the roll of sheet product in the dispenser such that the roll of sheet product rests on and is substantially supported by a dispensing mechanism and a roll interface; and rotating a feed roller of the dispensing mechanism to unseal the sealed tail and direct the unsealed tail into the dispensing mechanism via a separating member of the roll interface.

52. The method of paragraph 51, further comprising folding the sealed tail by rotating the roll of sheet product such that the sealed tail contacts a folding member of the roll interface.

53 The method of paragraph 51, further comprising removing a wrapper from the roll of sheet product after placing the roll of sheet product in the dispenser.

54. The method of paragraph 53, wherein the wrapper comprises a tabbed portion and a predefined area of weakness extending along the tabbed portion, and wherein removing the wrapper from the roll of sheet product comprises pulling the tabbed portion.

55. The method of paragraph 53, wherein the housing comprises a cover configured to move from an open position to a closed position, and wherein removing the wrapper from the roll of sheet product comprises removing the wrapper from the roll of sheet product while the cover is in the closed position.

56. The method of paragraph 53, wherein the wrapper comprises a polymer film.

57. The method of paragraph 51, wherein the roll of sheet product is contained within a cartridge comprising the roll interface.

Although certain embodiments of the disclosure are described herein and shown in the accompanying drawings, one of ordinary skill in the art will recognize that numerous modifications and alternative embodiments are within the scope of the disclosure. Moreover, although certain embodiments of the disclosure are described herein with respect to specific sheet product dispenser configurations, it will be appreciated that numerous other sheet product dispenser configurations are within the scope of the disclosure. Conditional language used herein, such as "can," "could," "might," or "may," unless specifically stated otherwise, or otherwise understood within the context as used, generally is intended to convey that certain embodiments include, while other embodiments do not include, certain features, elements, or functional capabilities. Thus, such conditional language generally is not intended to imply that certain features, elements, or functional capabilities are in any way required for all embodiments.

We claim:

1. A sheet product dispenser for dispensing sheet product from a roll of sheet product having a sealed tail sealed to a remainder of the roll of sheet product, the dispenser comprising:

a roll interface configured to engage and at least partially support the roll of sheet product, the roll interface comprising a separating member comprising an edge configured to engage and unseal the sealed tail from the remainder of the roll of sheet product;

a feed roller assembly configured to dispense sheet product from the roll of sheet product, the feed roller assembly comprising a feed roller configured to engage and at least partially support the roll of sheet product; and an electronic controller operable to initiate driving of the feed roller and rotation of the roll of sheet product such that the sealed tail is unsealed by engaging the separating member.

2. The sheet product dispenser of claim 1, wherein the electronic controller is operable to initiate driving of the feed roller and rotation of the roll of sheet product in response to the roll interface initially engaging the roll of sheet product.

3. The sheet product dispenser of claim 2, further comprising a roll sensor in communication with the electronic controller, the roll sensor configured to detect initial engagement between the roll interface and the roll of sheet product.

4. The sheet product dispenser of claim 1, further comprising an input device or a proximity sensor, wherein the electronic controller is operable to initiate driving of the feed roller and rotation of the roll of sheet product in response to activation of the input device or the proximity sensor.

5. The sheet product dispenser of claim 1, wherein the roll interface further comprises a roll interface opening configured to allow a portion of the roll of sheet product to extend therethrough and engage the feed roller.

6. The sheet product dispenser of claim 5, wherein:

the roll interface further comprises a folding member configured to engage and fold the sealed tail, and the separating member and the folding member are spaced apart from one another to define the roll interface opening therebetween.

7. The sheet product dispenser of claim 1, wherein the roll interface and the feed roller are configured to support the roll of sheet product such that a longitudinal axis of the feed roller is laterally offset from a longitudinal axis of the roll of sheet product.

8. A method of automatically loading a roll of sheet product in a sheet product dispenser, the roll of sheet product having a sealed tail sealed to a remainder of the roll of sheet product, the method comprising:

placing the roll of sheet product in the dispenser such that the roll of sheet product rests on and is substantially supported by a dispensing mechanism and a roll interface; and rotating a feed roller of the dispensing mechanism to unseal the sealed tail from the remainder of the roll of sheet product and direct the unsealed tail into the dispensing mechanism via a separating member of the roll interface.

9. The method of claim 8, further comprising folding the sealed tail by rotating the roll of sheet product such that the sealed tail contacts a folding member of the roll interface.

10. The method of claim 8, further comprising removing a wrapper from the roll of sheet product after placing the roll of sheet product in the dispenser.

11. The method of claim 10, wherein the wrapper comprises a tabbed portion and a predefined area of weakness extending along the tabbed portion, and wherein removing the wrapper from the roll of sheet product comprises pulling the tabbed portion.

12. The method of claim 10, wherein the dispenser comprises a cover configured to move from an open position to a closed position, and wherein removing the wrapper from the roll of sheet product comprises removing the wrapper from the roll of sheet product while the cover is in the closed position.

13. The method of claim 10, wherein the wrapper comprises a polymer film.

14. The method of claim 8, wherein the roll of sheet product is contained within a cartridge comprising the roll interface.

15. The method of claim 8, wherein rotating the feed roller of the dispensing mechanism comprises activating a motor of the dispensing mechanism via an electronic controller of the dispenser in response to the roll interface initially engaging the roll of sheet product.

16. The method of claim 8, wherein the sealed tail of the roll of sheet product is sealed to remainder of the roll of sheet product along a sealed region positioned near but offset from a distal end of the tail.

17. The method of claim 16, wherein placing the roll of sheet product in the dispenser comprises orienting the roll of sheet product in the dispenser such that the distal end of the sealed tail extends away from the sealed region in a direction of rotation of the roll of sheet product.

18. The sheet product dispenser of claim 1, further comprising:

a cover configured to move from an open position to a closed position; and a cover switch in communication with the electronic controller, the cover switch configured to be activated by movement of the cover from the open position to the closed position;

wherein the electronic controller is operable to initiate driving of the feed roller and rotation of the roll of sheet product in response to activation of the cover switch.

19. The sheet product dispenser of claim 1, wherein the feed roller assembly further comprises:

a first pinch roller positioned adjacent the feed roller and defining a first nip therebetween configured to receive the sheet product; and a second pinch roller positioned adjacent the feed roller and defining a second nip therebetween configured to receive the sheet product.

20. The sheet product dispenser of claim 5, wherein the edge of the separating member comprises a serrated edge extending along the roll interface opening.

* * * * *